US009201373B2

(12) United States Patent
Awano

(10) Patent No.: US 9,201,373 B2
(45) Date of Patent: Dec. 1, 2015

(54) RECORDING MATERIAL POST-PROCESSING DEVICE AND RECORDING MATERIAL PROCESSING APPARATUS USING THE SAME

(71) Applicant: FUJI XEROX CO., LTD.

(72) Inventor: Hiroaki Awano, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/168,570

(22) Filed: Jan. 30, 2014

(65) Prior Publication Data

US 2014/0147185 A1 May 29, 2014

Related U.S. Application Data

(62) Division of application No. 12/134,579, filed on Jun. 6, 2008, now Pat. No. 8,706,019.

(30) Foreign Application Priority Data

Nov. 9, 2007 (JP) ..... 2007-292050

(51) Int. Cl.
*G03G 15/00* (2006.01)
*G03G 21/16* (2006.01)

(52) U.S. Cl.
CPC ..... *G03G 15/6582* (2013.01); *G03G 15/6538* (2013.01); *G03G 15/6552* (2013.01);
(Continued)

(58) Field of Classification Search
CPC ... G03G 15/00; G03G 21/16; G03G 15/6582; G03G 15/6538; G03G 15/6552; G03G 2215/00421; G03G 2215/00426; G03G 2215/00827; G03G 2215/00877
USPC ..... 399/407, 408, 410, 110
See application file for complete search history.

(56) References Cited

U.S. PATENT DOCUMENTS 5,105,229 A 4/1992 Ozaki
5,137,265 A * 8/1992 Sato et al. ..... 270/58.12
(Continued)

FOREIGN PATENT DOCUMENTS

CN 1915679 A 2/2007
JP 2001010759 A * 1/2001 ..... G03G 15/00
(Continued)

OTHER PUBLICATIONS

Japanese Office Action in counterpart Japanese Application No. 2007-292050 dated Jan. 19, 2010.
(Continued)

*Primary Examiner* — Nguyen Ha
(74) *Attorney, Agent, or Firm* — Sughrue Mion, PLLC

(57) ABSTRACT

The recording material post-processing device includes a post-processing mechanism, and additional post-processing mechanism and a transport control unit. The post-processing mechanism performs a post-process for a recording material transported from one branched transport path of an image forming device. The additional post-processing mechanism performs an additional post-process other than the post-process performed by the post-processing mechanism for the recording material transported from the other branched transport path of the image forming device. The transport control unit controls transport of the recording material such that the post-process using the post-processing mechanism is performed after the post-process using the additional post-processing mechanism is performed.

8 Claims, 35 Drawing Sheets

(52) U.S. Cl.
CPC ..... *G03G2215/00421* (2013.01); *G03G 2215/00426* (2013.01); *G03G 2215/00827* (2013.01); *G03G 2215/00877* (2013.01)

(56) References Cited

U.S. PATENT DOCUMENTS

| | | | | | |
|---|---|---|---|---|---|
| 5,852,765 | A * | 12/1998 | Yamashita et al. | ..... | 399/407 |
| 5,926,684 | A | 7/1999 | Horiuchi et al. | | |
| 6,647,243 | B2 * | 11/2003 | Kato et al. | ..... | 399/407 |
| 6,725,011 | B2 | 4/2004 | Sato | | |
| 7,077,393 | B2 | 7/2006 | Ishida | | |
| 7,450,881 | B2 | 11/2008 | Kenji et al. | | |
| 7,515,871 | B2 | 4/2009 | Mae et al. | | |
| 7,657,205 | B2 * | 2/2010 | Kang | ..... | 399/110 |
| 7,658,372 | B2 | 2/2010 | Kubo | | |
| 7,822,379 | B2 | 10/2010 | Nakamura et al. | | |
| 2001/0048831 | A1 * | 12/2001 | Matsumoto et al. | ..... | 399/405 |
| 2005/0232672 | A1 * | 10/2005 | Nakamura et al. | ..... | 399/405 |
| 2006/0017209 | A1 * | 1/2006 | Kushida et al. | ..... | 270/37 |
| 2007/0040328 | A1 | 2/2007 | Hattori | | |
| 2007/0052148 | A1 * | 3/2007 | Kubo | ..... | 270/58.08 |

FOREIGN PATENT DOCUMENTS

| | | | | | |
|---|---|---|---|---|---|
| JP | 2001072311 | A * | 3/2001 | ..... | G03G 15/00 |
| JP | 2002-308520 | A | 10/2002 | | |
| JP | 3577894 | B2 | 7/2004 | | |
| JP | 2004-277036 | A | 10/2004 | | |
| JP | 2005-154080 | A | 6/2005 | | |
| JP | 2005-343661 | A | 12/2005 | | |
| JP | 2007-22800 | A | 2/2007 | | |
| JP | 2007022800 | A * | 2/2007 | ..... | G03G 15/00 |
| JP | 2007-70095 | A | 3/2007 | | |
| JP | 2007070095 | A * | 3/2007 | ..... | B65H 37/04 |
| JP | 2007-269488 | A | 10/2007 | | |

OTHER PUBLICATIONS

Notification of the First Office Action in counterpart Chinese Application No. 200810125754.4 dated Nov. 12, 2010.

Korean Office Action dated Nov. 19, 2010 issued in a counterpart application No. 10-2008-0055221.

* cited by examiner

RECORDING MATERIAL POST-PROCESSING DEVICE AND RECORDING MATERIAL PROCESSING APPARATUS USING THE SAME

CROSS-REFERENCE TO RELATED APPLICATIONS

This application is a divisional of U.S. application Ser. No. 12/134,579 filed on Jun. 6, 2008, which claims priority under 35 USC 119 from Japanese Patent Application No. 2007-292050 filed Nov. 9, 2007.

1. TECHNICAL FIELD

The present invention relates to a recording material post-processing device and a recording material processing apparatus using the recording material post-processing device.

2. RELATED ART

General recording material processing apparatuses each having a recording material post-processing device have been provided.

SUMMARY

According to a aspect of the invention, a recording material post-processing device (i) is installed to an image forming device having a branched transport path branched in two through which a recording material is transported to be discharged and (ii) performs a post-process for the recording material on which an image is formed by the image forming device. The recording material post-processing device includes a post-processing mechanism, and additional post-processing mechanism and a transport control unit. The post-processing mechanism performs a post-process for the recording material transported from one branched transport path of the image forming device. The additional post-processing mechanism performs an additional post-process other than the post-process performed by the post-processing mechanism for the recording material transported from the other branched transport path of the image forming device. The transport control unit controls transport of the recording material such that the post-process using the post-processing mechanism is performed after the post-process using the additional post-processing mechanism is performed.

BRIEF DESCRIPTION OF THE DRAWINGS

Exemplary embodiments of the present invention will be described in detail based on the following figures, wherein.

DETAILED DESCRIPTION

First, an overview of exemplary embodiments of the present invention will be described.

Figure 1:
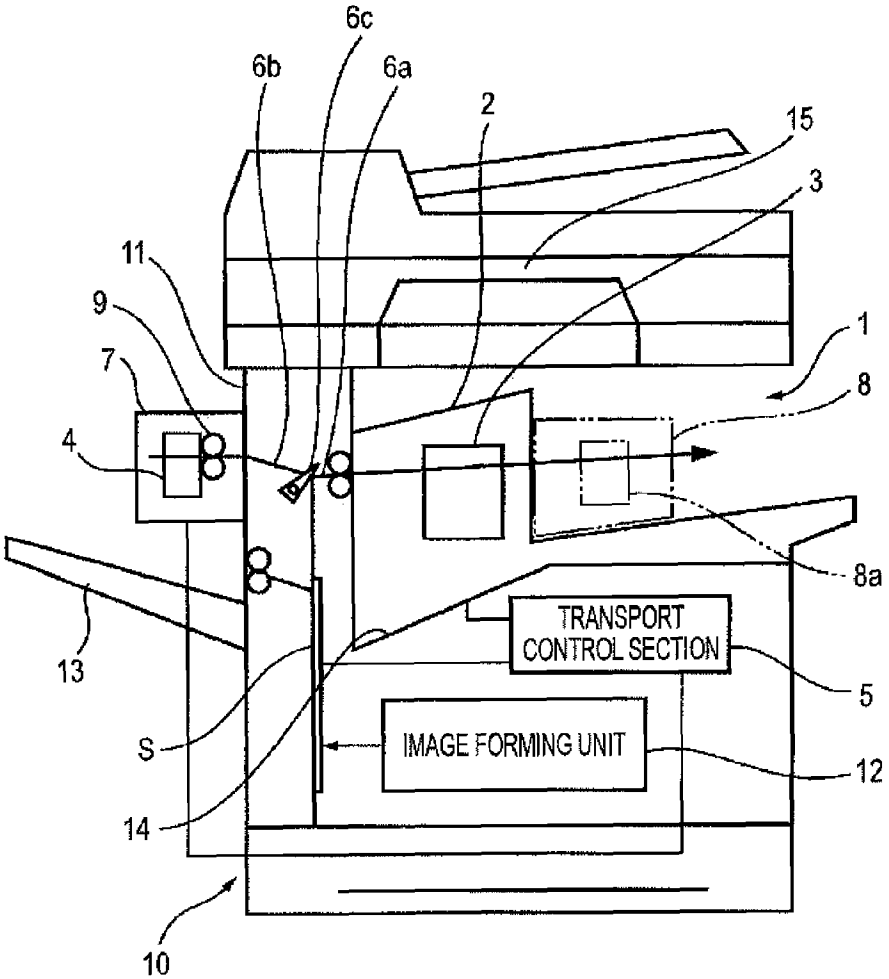
FIG. 1 is shows an overview of a recording material processing apparatus according to representative model 1 of an exemplary embodiment of the present invention.

FIG. 1 shows an overview of a recording material processing apparatus according to representative model 1 of an exemplary embodiment of the present invention.

In the figure, the recording material processing apparatus has an image forming device 10 that forms an image on a recording material S and a recording material post-processing device 1 that performs a post process for the recording material S on which an image has been formed by the image forming device 10.

In the representative model according to this exemplary embodiment, the image forming method used in the image forming device 10 may be appropriately selected from among an electro-photographic method, an ink jet method, and the like, as long as the image forming device has an image forming unit 12 built inside an image forming device casing 11. In addition, the image forming device 10 is not limited to a form in which an image reading unit 15 is disposed above the image forming device casing 11 through a concave portion 14, and the image forming device 10 may not include the image reading unit 15.

Here, as a form in which the recording material post-processing device 1 is disposed so as to effectively use an installation space of the image forming device 10, a configuration in which a post-processing device casing 2 of the recording material post-processing device 1 is disposed above the image forming device casing 11 and a recording material S for which creation of an image formed by the image forming unit 12 has been completed within the installation space of the image forming device casing 11 is led to the recording material post-processing device 1 may be used.

In this exemplary embodiment, as a recording material S, a sheet on which an image can be formed is used. The recording material includes not only a paper sheet but also a special sheet having a coating layer, an OHP sheet, and the like in a broad range.

In representative model 1 according to this exemplary embodiment, the image forming device 10 has branched transport paths 6 (for example, 6*a* and 6*b*) branched into two through which the recording material S is transported so as to be discharged. These branched transport paths 6 (6*a* and 6*b*) are connected to an un-branched recording material transporting path in the shape of an approximate letter "T". There are many cases that shifting unit 6*c* is disposed at a branching position for shifting between the branched transport paths 6.

The recording material post-processing device 1, for example, includes a post-processing mechanism 3 that performs a given post-process for the recording material S transported from one branched transport path 6 (for example, 6*a*) of the image forming device 10, an additional post-processing mechanism 4 that performs an additional post-process other than the post-process performed by the post-processing mechanism 3 for the recording material S transported from the other branched transport path 6 (for example, 6*b*) of the image forming device 10, and transport control unit 5 that controls transport of the recording material S such that a post-process is performed by the post-processing mechanism 3 after a post-process is performed by the additional post-processing device 4.

Figure 2:
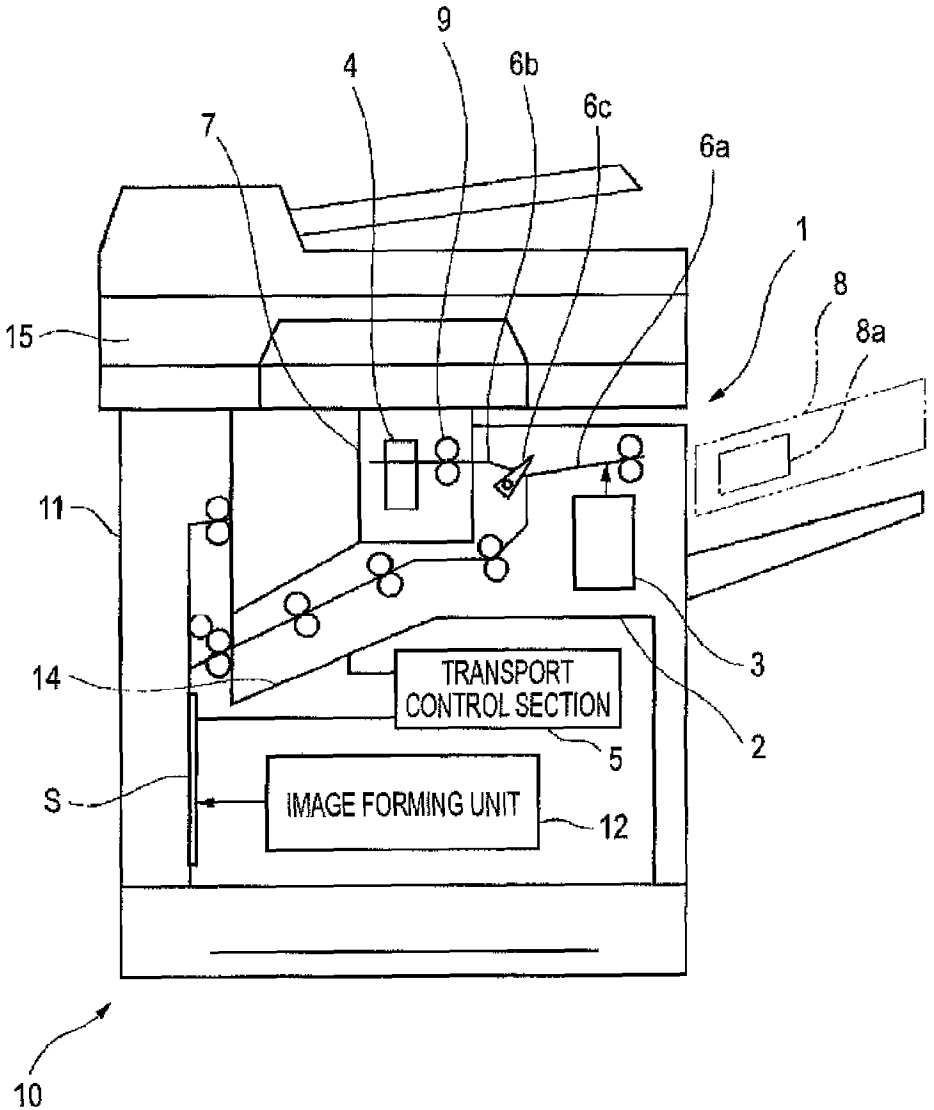
FIG. 2 is shows an overview of a recording material processing apparatus according to representative model 2 of an exemplary embodiment of the present invention.

The recording material processing apparatus according to representative model 2 of the exemplary embodiment, as shown in FIG. 2, is similar to representative model 1 of the exemplary embodiment. The recording material processing apparatus has an image forming device 10 that forms an image on the recording material S and a recording material post-processing device 1 that performs a post-process for the recording material S on which the image is formed by the image forming device 10.

However, in representative model 2, differently from representative model 1, branched transport paths branched in two are not particularly needed on the image forming device 10 side. The recording material post-processing device 1 includes a post-processing device casing 2 that has branched transport paths 6 (for example, 6*a* and 6*b*) branched in two through which the recording material S is transported, a post-processing mechanism 3 that performs a given post-process for the recording material S transported to one branched transport path 6 (for example, 6*a*), an additional post-processing mechanism 4 that performs an additional post-process other than the post-process performed by the post-processing mechanism 3 for the recording material S transported to the other branched transport path 6 (for example, 6*b*), and transport control unit 5 that controls transport of the recording material S such that a post-process is performed by the post-processing mechanism 3 after a post-process is performed by the additional post-processing device 4.

The recording material processing apparatus according to representative model 2 is additionally attached to the image forming device 10. However, the recording material processing apparatus may be provided independently from the image forming device 10.

In such technological means, the branched transport paths 6 (6*a* and 6*b*) may be disposed in the image forming device 10 (more particularly, an image forming device casing 11) or a recording material post-processing device 1 (more particularly, a post-processing device casing 2). However, when the branched transport paths 6 are disposed originally, they may be used. Alternatively, when the additional post-processing mechanism 4 is disposed, the branched transport paths 6 may be newly added.

The number of the post-processing mechanisms 3 is not limited to one, and a plurality of the post-processing mechanisms 3 may be provided. The post-processing mechanism mentioned here may be appropriately selected from among an edge stapling mechanism, a saddle stapling mechanism, and the like, as long as the post-processing mechanism has a standard equipment specification.

In addition, the number of the additional post-processing mechanisms 4 is not limited to one, and a plurality of the additional post-processing mechanisms 3 may be provided. The additional post-processing mechanism 4 mentioned here may be appropriately selected as a mechanism to be added for a post-processing function other than the function of the post-processing mechanism 3. For example, when the post-processing mechanism 3 has an edge stapling mechanism and a saddle stapling mechanism, the added function, for example, may be a bi-folding mechanism and a hole punching mechanism.

In addition, the post-processing mechanism 3 and the additional post-processing mechanism 4 may be appropriately disposed with the branched transport paths 6, which are branched in two, interposed therebetween.

For performing the post-process for the recording material S by using the additional post-processing mechanism 4, the transport control unit 5 may be configured to directly lead the recording material S to the branched transport path 6 (for example, 6*b*) that is connected to the additional post-processing mechanism 4. Alternatively, the transport control unit 5 may be configured to lead the recording material S to one branched transport path 6 (for example, 6*a*) temporarily and then lead the recording material to the other branched transport path 6 (for example, 6*b*) by performing a switching back operation.

In view of simplifying the process for installing the additional post-processing mechanism 4, the additional post-processing mechanism 4 may be installed to an additional auxiliary device 7 that is detachably attached to the image forming device casing 11 or the post-processing device casing 2.

In addition, the layout of the additional post-processing mechanism 4 may be appropriately selected. However, for example, when a form in which the additional post-processing mechanism 4 is disposed on the outside of the image forming device casing 11 or the post-processing device casing 2 is used, the transport control unit 5 may perform the post-process by using the additional post-processing mechanism 4 while maintaining a state that a part of the recording material S is discharged to the outside of the image forming device casing 11 or the post-processing device casing 2 after transporting the recording material S to one branched transport path 6 (for example 6*a*).

In addition, when a form in which a recording material housing tray 13 protruded outside the image forming device casing 11 and housing a discharged recording material S is included is used, an externally protruded space of the recording material housing tray 13 should be acquired as an installation space of the image forming device 10. Accordingly, in view of not enlarging an unnecessary installation space of the additional post-processing mechanism 4, the additional post-processing mechanism 4 may be disposed in a position outside the image forming device casing 11 and above the recording material housing tray 13.

In addition, when a form in which a recording material discharging unit formed by a concave portion 14 is included in the image forming device casing 11, the recording material port-processing device 1 may be installed through the recording material discharging unit formed by the concave portion 14, in view of not enlarging an unnecessary installation space of the recording material post-processing device 1.

When the post-processing function of the recording material post-processing device 1 is to be expanded, an expanded auxiliary device 8 to which an expanded post-processing mechanism 8*a* is installed is additionally disposed to be detachably attached to the post-processing device casing 2. In this form, the expanded auxiliary device 8 may be provided not only for the branched transport paths 6 (6*a* and 6*b*) that are branched in two but also for the other transport paths.

In addition, as a form of the additional auxiliary device 7, in view of maintaining excellent precision of the post-process performed by the additional post-processing mechanism 4, for example, a form in which a position adjusting transport member 9 that can transport the recording material S in a position-adjusted state is included in the additional post-processing mechanism 4 may be used.

In addition, as a form of the transport control unit 5, a form in which a transport sequence of the recording material S using the branched transport paths 6 (6*a* and 6*b*) branched in two as so-called buffer paths is built may be used. As an example of a transport sequence of this type, after a rear end of the recording material S for which the post-process is performed by the additional post-processing mechanism 4 passes the branching position of the branched transport path 6 and reaches the branched transport path 6 (for example, 6*a*) on the post-processing mechanism 3 side, the subsequent recording material S is transported to be led to the branched transport path 6 (for example. 6*b*) on the additional post-processing mechanism 4 side.

Figure 3:
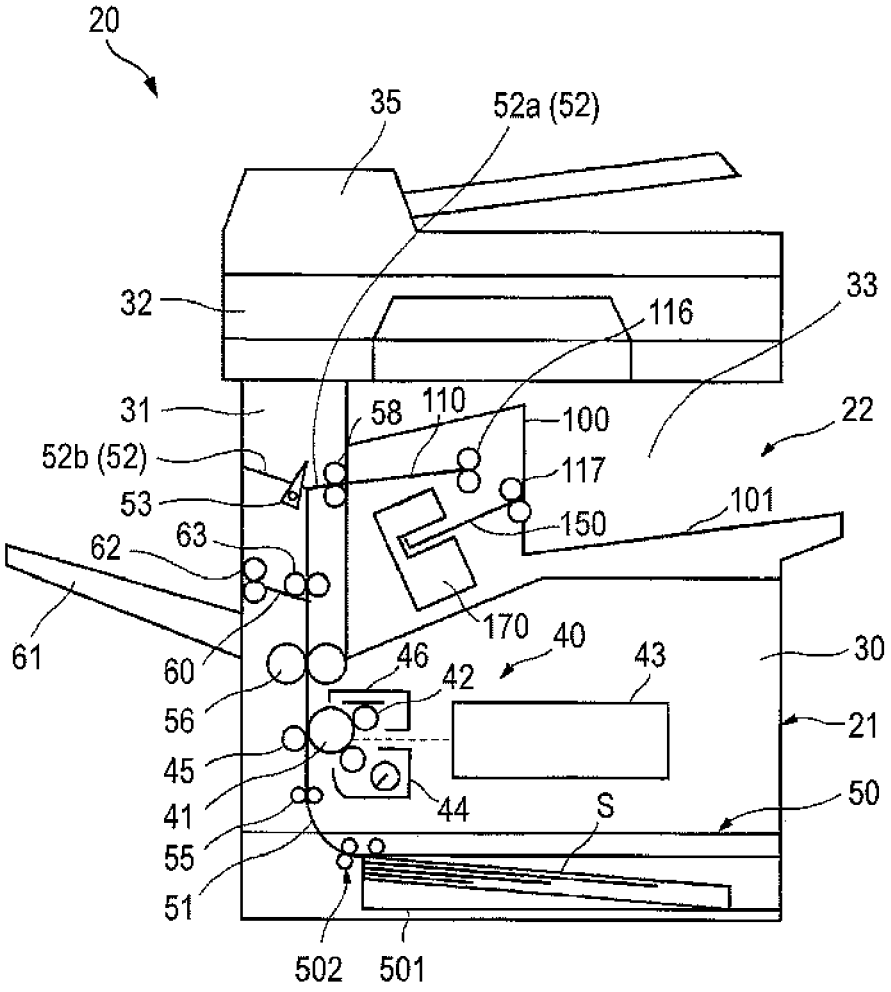
FIG. 3 is a diagram showing the whole configuration of a recording material processing apparatus according to exemplary embodiment 1.

Hereinafter, the present invention will be described in detail based on exemplary embodiments shown in the accompanying drawings FIG. 3 shows a recording material processing apparatus according to exemplary embodiment 1 of the present invention.

A recording material processing apparatus 20 according to this exemplary embodiment, as shown in FIG. 3, includes an image forming device 21 that forms an image on a recording material S and a recording material post-processing device 22 that is detachably attached to the image forming device 21 in advance and performs a post-process for the recording material S for which a recording process has been completed.

In this exemplary embodiment, the image forming device 21 has an image forming device casing (hereinafter, referred to as a device casing) 30 in which an image forming unit 40 is built. In the image forming device 21, a protruded part 31 that protrudes upward is disposed on one side of the upper part of the device casing 30 in the width direction, an image reading device 32 is disposed on the protruded part 31 of the device casing 30, and a concave portion 33 between the image reading device 32 and the top portion of the device casing 30 other than the protruded part 31 is acquired as a space portion inside the main body. As the form of disposition of the image reading device 32, for example, a configuration in which the image reading device 32 is directly placed on a support board (not shown) separated from the device casing 30 may be used. Alternatively, the image reading device 32 may be directly disposed in the device casing 30. In addition, the image reading device 32 includes an automatic document supply mechanism 35 that automatically supplies a document to an image reading surface.

On the other hand, the recording material post-processing device 22 has a post-processing device casing 100 to which a recording material S for a post-process is transported. In the recording material post-processing device 22, the post-processing device casing 100 is housed in a space portion 33 inside the main body of the image forming device 21, and a recording material discharging unit 101 that slightly protrudes toward the outside the device casing 30 from the space portion 33 inside the main body is formed to protrude in a part of the post-processing device casing 100.

In the image forming device 21 shown in FIG. 3, the image forming unit 40 is disposed inside the device casing 30, and below the image forming unit 40, for example, one recording material supplying device 50 is disposed. In addition, a recording material transporting path 51 that extends from the recording material supplying device 50 to the image forming unit 40 is disposed in an approximately vertical direction.

Here, the image forming unit 40, for example, uses an electrophotographic method. The image forming unit 40 has a photoreceptor drum 41 that forms and maintains a toner image, a charging device 42 such as a charging roller that charges the photoreceptor drum 41, an exposure device 43 such as a laser scanning device that forms a latent image on the charged photo sensitive drum 41, a developing device 44 that develops the electrostatic latent image formed on the photo sensitive drum 41 into a visible image, a transfer device 45 such as a transfer roll that transfers the toner image formed on the photo sensitive drum 41 to a recording material S supplied from the recording material supplying device 50, and a cleaning device 46 that cleans toner remaining on the photo sensitive drum 41, as its major components.

In addition, the recording material supplying device 50 has a container 501 in which the recording material S is deposed and housed. The recording material supplying device 50 is configured to supply recording materials S inside the container 501 while separating the recording materials one by one by using a feeder 502.

In addition, on the upstream side of a transfer-position portion of the image forming unit 40 in the recording material transporting path 51, a position adjusting roller 55 that adjusts the position of the recording material S and then transports the recording material is disposed. In addition, on the downstream side of the transfer-position portion of the image forming unit 40 in the recording material transporting path 51, a fixing device 56 is disposed.

In addition, on the downstream side of the fixing device 56 in the recording material transporting path 51, branched transport paths 52 (more particularly, 52*a* and 52*b*) disposed toward the recording material post-processing device 22 side and the outside of the device casing 30 are provided. In the boundary between the recording material transporting path 51 and the branched transport path 52, a shift claw 53 is disposed, and near the downstream end of one branched transport path 52 (for example, 52*a*), a discharge roll 58 is disposed. In addition, on the downstream side of the fixing device 56 in the recording material transporting path 51, a branched discharge path 60 that is connected to the outside of the device casing 30 is disposed. On the outside of the device casing 30 near the exit of the branched discharge path 60, the recording material housing tray 61 is disposed to protrude outward. In addition, a reference numeral 62 is a discharge roll 62 for discharging the recording material to the recording material discharging tray 61, and a reference numeral 63 is transport rolls of an appropriate number disposed in the recording material transporting path 51 or transport members corresponding thereto.

FIG. 3 shows an overview of a recoding sheet post-processing device 22 of a standard equipment specification which is installed to the image forming device 21. FIG. 4 shows the detailed configuration of the recording material post-processing device.

In the figure, the post-processing device casing 100 is inserted into a space portion 33 inside the main body of the image forming device 21, and the front end portion of the post-processing device casing 100 is disposed to be brought into contact with the side of the space portion 33 inside the main body of the protruded part 31. In the post-processing device casing 100, a recording material transporting path 110 that has an entrance opening in a spot opened to the branched transport path 52 of the image forming device 21 and extends in the horizontal direction is disposed.

In addition, in this exemplary embodiment, a transport roll 116 is disposed in the recording material transporting path 110. In addition, below the transport roll 116 in the recording material transporting path 110, a position determining and housing tray 150 that temporarily determines the position of plural recording materials S and houses the plural recording materials is disposed.

In addition, in the post-processing device casing 100, a discharge roll 117 that discharges and transports a bundle of recording materials S housed in the position determining and housing tray 150 to the recording material discharging unit 101 is disposed.

Below the recording material transporting path 110, an edge stapling mechanism 170 as a post-processing mechanism for binding an end portion of the recording material S of which position is determined in the position determining and housing tray 150 is disposed.

The position determining and housing tray 150 used in this exemplary embodiment is shown in FIG. 4.

Figure 4A:
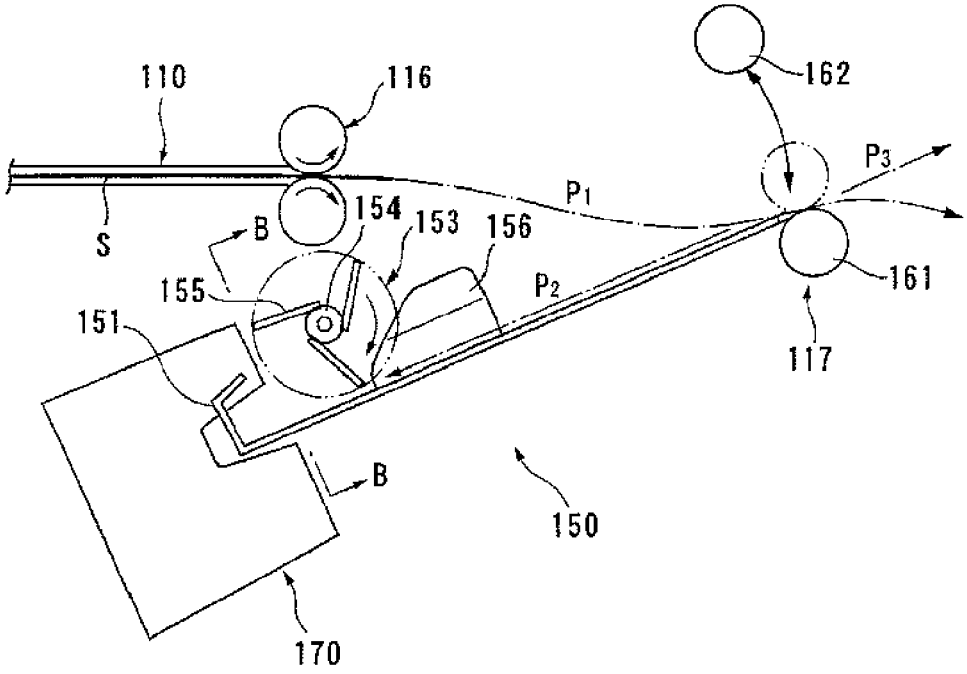
FIG. 4A is a diagram showing an edge stapling mechanism in detail as a post-processing mechanism of a recording material post-processing device used in exemplary embodiment 1.
Figure 4B:
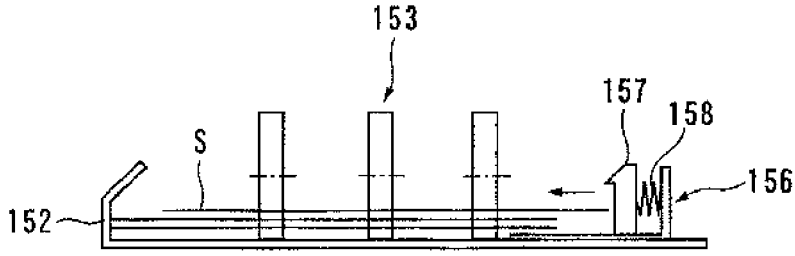
FIG. 4B is a diagram viewed from direction B-B shown in FIG. 4A.

In FIGS. 4A and 4B, the position determining and housing tray 150 is disposed with a tilt so as to lower a side opposite to a side from which the recording material S is discharged such that the recording material S discharged from the transport roll 116 of the recording material transporting path 110 can drop naturally. In addition, a position determining wall 151 serving as a position determining unit is formed in the lower end portion of the position determining and housing tray 150, and a side edge position determining wall 152 serving as a position determining unit is formed in an edge on a side adjacent to the position determining wall 151.

In addition, in positions near the position determining wall 151 of the position determining and receiving tray 150, plural (in this example, three) rotation adjusting members 153 is disposed. In a portion, which faces the side edge position determining wall 152, of the position determining and receiving tray 150, a pressure adjusting member 156 that presses the recording material S is disposed.

In this exemplary embodiment, the rotation adjusting members 153 are provided by disposing plural elastic blades 155 around the rotation shaft 154 in the diameter direction. In a rotation operation, the elastic blades 155 are transformed elastically, and the recording material S placed in the position determining and housing tray 150 is adjusted uniformly toward the position determining wall 151.

In addition, the pressure adjusting member 156 is moved to be disposed in a position corresponding to the size of the recording material S by a driving mechanism not shown in the figure. The pressure adjusting member 156 presses the recording material S to the side edge position determining wall 152 side by using a pressure plate 157 that is biased by a biasing spring 158.

A support structure of the discharge roll 117 used in this exemplary embodiment is shown in FIG. 5.

Figure 5A:
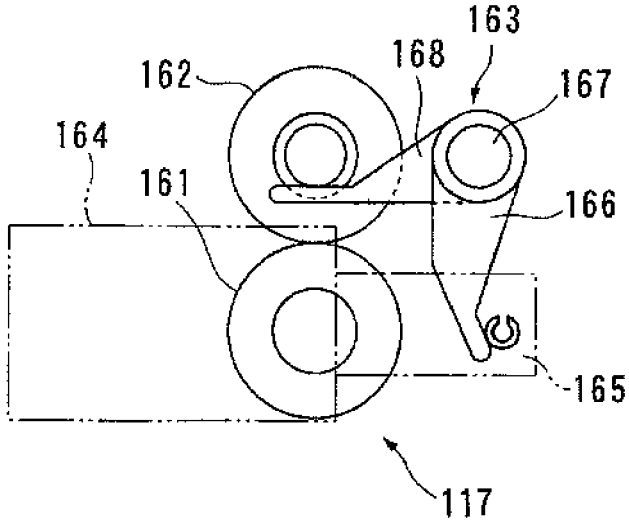
FIGS. 5A and 5B are diagrams showing examples of transport rolls that are attachment/detachment members.
Figure 5B:
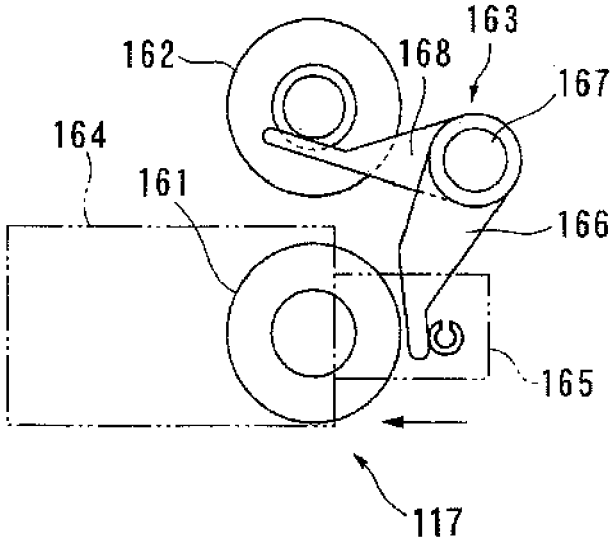

In FIGS. 5A and 5B, the support structure of the discharge roll 117 includes a driving roll 161 that is driven to be rotated by a support shaft that is fixed in position and an attachment/detachment roll 162 that can be attached/detached to/from the driving roll 161 and is driven to be rotated by the driving roll 161 for pinching a bundle of the recording materials S between the driving roll 161 and the attachment/detachment roll 162.

In the attachment/detachment roll 162, an attachment/detachment mechanism 163 is disposed. In the attachment/detachment mechanism 163, for example, a connection member 166 having one end connected to an actuating bar 165 of a driving actuator 164 moving straight is disposed to be rotatable around a rotation shaft 167. And the attachment/detachment roll 162 is moved in a direction for being apart from the driving roll 161 by an arm member 168 that is rotated in accordance with rotation of the rotation shaft 167 of the connection member 166. In addition, the attachment/detachment roll 162 is biased to the driving roll 161 side by a biasing spring not shown in the figure with a given pressing force.

In the position determining and housing tray 150 and the discharge roll 117, for example, in a process for housing the recording material S in the position determining and housing tray 150, as shown in FIG. 4A, the attachment/detachment roll 162 of the discharge roll 117 is disposed to be spaced apart from the driving roll 161. In addition, in the process, after the recording material S discharged from the transport roll 116 is moved as denoted by $P_1$, the recording material S drops at a time point when the rear end of the recording material S is apart from the transport roll 116. Then, the recording material S is moved along the tilt of the position determining and housing tray 150 in a direction denoted by $P_2$, and the recording material S is determined in position by the rotation adjusting member 153 and the pressure adjusting member 156 and housed in the position determining and housing tray 150.

Then, when the edge stapling process is performed by the edge stapling mechanism 170 to be described later, the discharge roll 117 pinches and transports the recording material S, and accordingly, the bundle of recording materials S for which the edge stapling process has been completed is transported toward a direction denoted by $P_3$.

Figure 6:
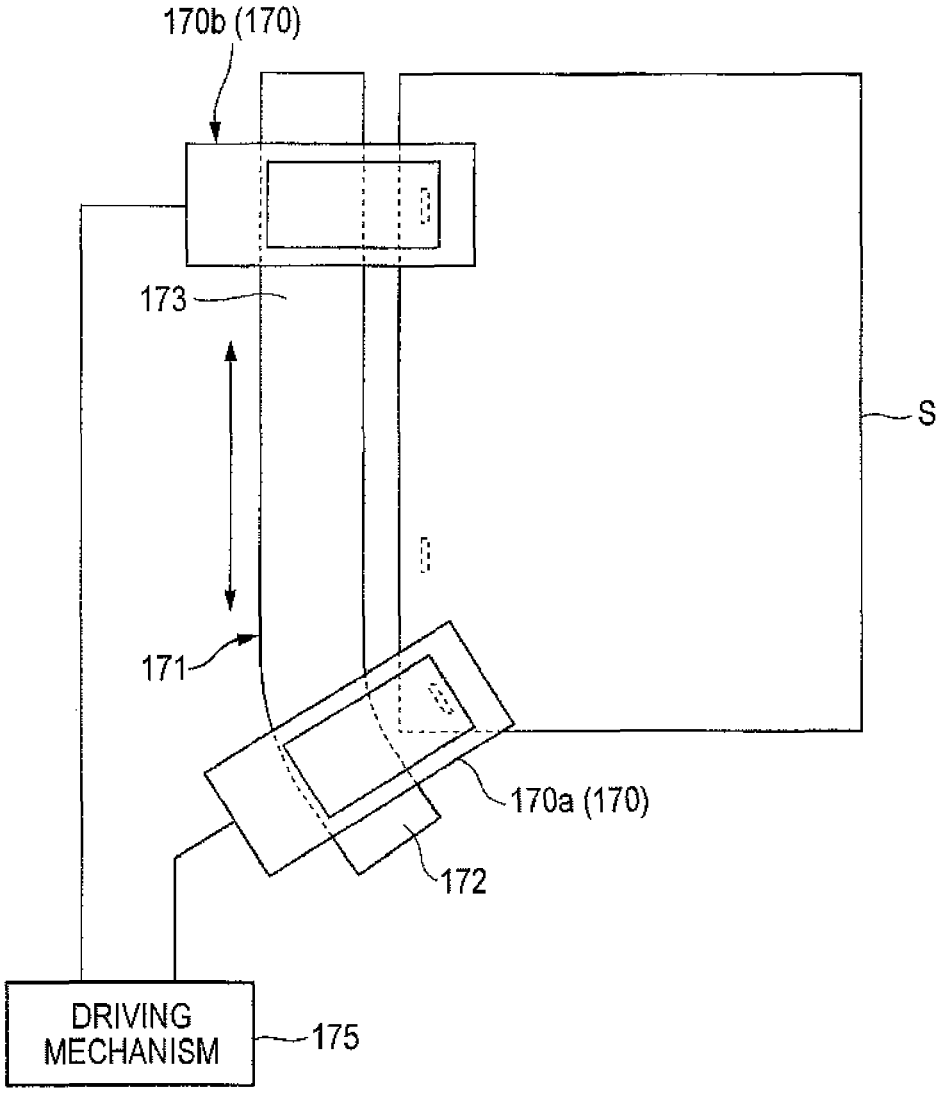
FIG. 6 is a diagram showing dispositional relationship of an edge stapling mechanism used in exemplary embodiment 1.

The edge stapling mechanism 170 used in this exemplary embodiment is shown in FIGS. 6 and 7 in details.

In this exemplary embodiment, the edge stapling mechanism 170, as shown in FIG. 6, includes a corner edge stapling mechanism 170*a* that binds one corner portion of the recording material S and a side edge stapling mechanism 170*b* that mainly binds an edge portion of one side of the recording material S. These edge stapling mechanisms 170 (170*a* and 170*b*) are disposed to be movable along a guide track 171 and are configured to be moved to an appropriate position by a driving mechanism 175 (for example, a mechanism that moves in accordance with a driving belt or the like is used). In addition, in this exemplary embodiment, the guide track 171 includes a curved track portion 172 having a circular arc shape in a position corresponding to one corner portion of the recording material S and a straight-line track portion 173 disposed along an edge of one side of the recording material S.

Particularly in this exemplary embodiment, the corner edge stapling mechanism 170*a* is disposed in correspondence with the curved track portion 172 as its initial position. In addition, the side edge stapling mechanism 170*b* is disposed in a position, which is apart from the curved track portion 172, of the straight-line track portion 173 as its initial position.

For example, in a two-spot edge stapling mode for binding one-side edges of the recording material S in two spots, the side edge stapling mechanism 170*b* may be sequentially moved to positions adjusted to the size of the recording material S so as to bind the recording materials in two spots. Alternatively, the two-spot edge stapling process may be performed by using all the corner edge stapling mechanism 170*a* and the side edge stapling mechanism 170*b*. The design of the edge stapling mechanisms may be changed appropriately.

An example of the configuration of the edge stapling mechanism 170 is shown in FIG. 7.

In this exemplary embodiment, the edge stapling mechanism 170 is disposed to be movable in a spot corresponding to a notch, not shown in the figure, on the position determining wall 151 side of the position determining and housing tray 150.

Figure 7A:
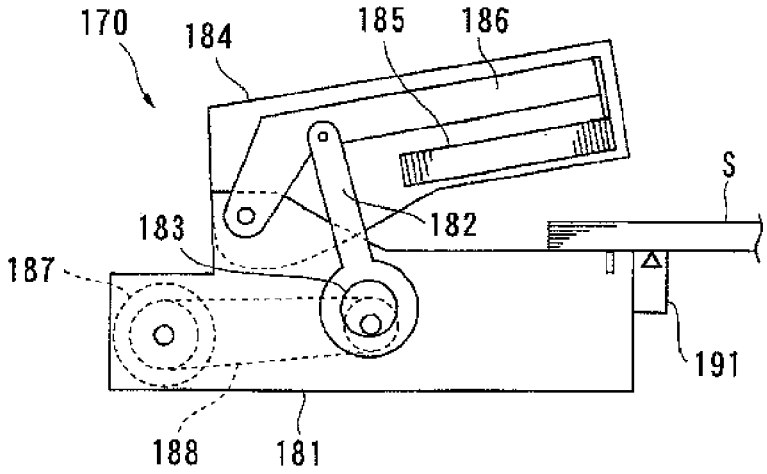
FIGS. 7A to 7C are diagrams showing the configuration and operation states of the edge stapling mechanism.
Figure 7B:
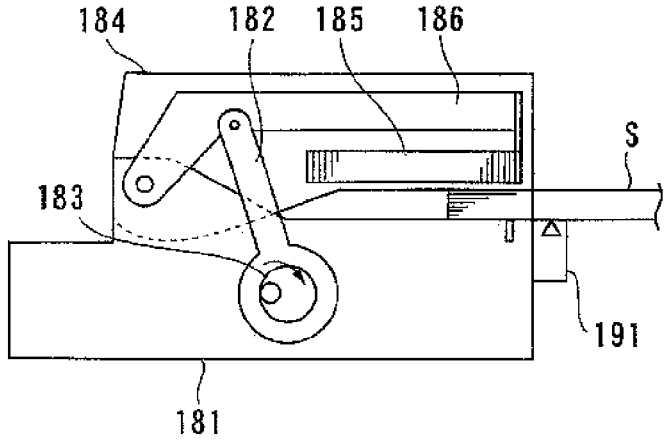
Figure 7C:
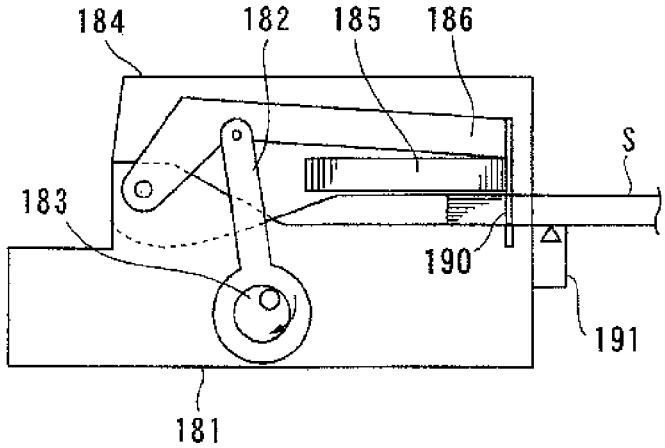

As a basic configuration of the edge stapling mechanism 170, as shown in FIG. 7A, the rear anchor of a movable arm 182 is supported to be rotatable around the rotation shaft 183 by a lower container 181 serving as a support board, an upper container 184 that is biased to the movable arm 182 side by a biasing spring having a same shaft as the movable arm 182 and not shown in the figure is disposed in the movable arm 182, and a binding needle housing unit 185 is disposed inside the upper container 184. In addition, a hammering mechanism 186 is disposed in the front end of the movable arm 182 so as to hammer a binding needle 190, and the movable arm 182 is moved downward in a binding operation by transferring the driving force of the driving motor 187 to the driving arm 182 through a drive transferring mechanism 188 (for example, a belt, an eccentric member, or the like is used). Then, as shown in FIGS. 7B and 7C, the binding needle 190 is hammered in an end portion of the bundle of the recording materials S by a hammering mechanism 186 that descends with the movable arm 182 in a state that the bundle of the recording materials S is pinched between the lower container 181 and the upper container 184. In addition, a reference numeral 191 is a detector for detecting whether there is a recording material which is disposed in the front end portion of the recording material S side of the lower container 181 serving as a support board, and, for example, is configured by using a reflection-type optical element.

Figure 8:
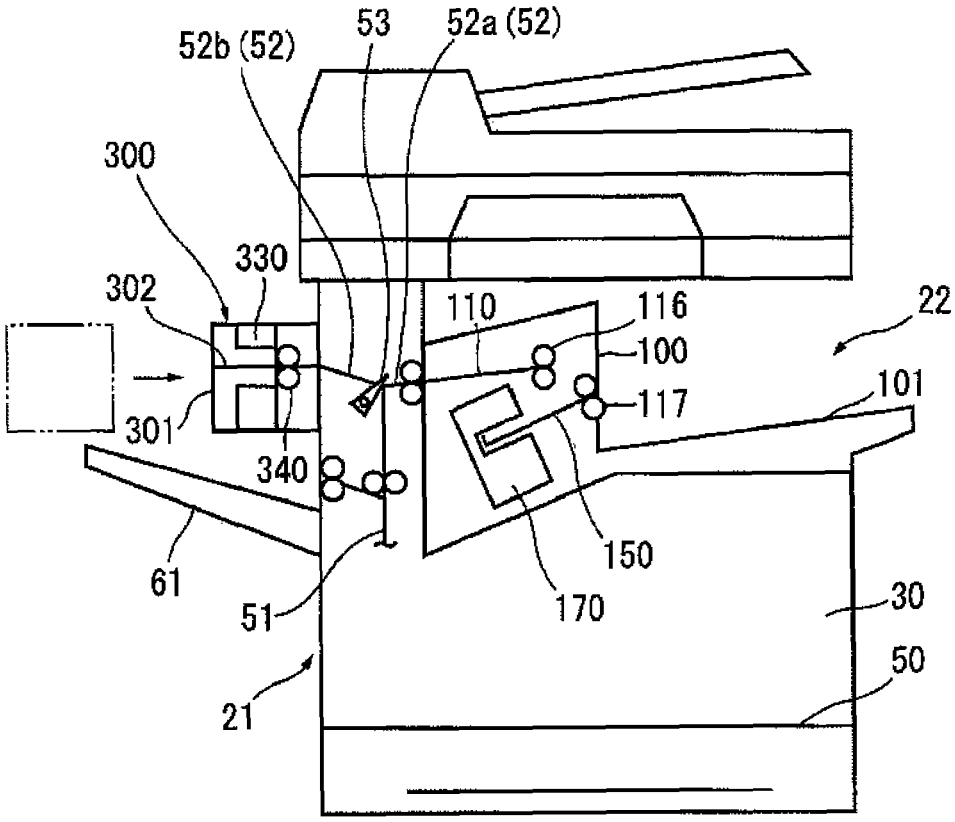
FIG. 8 is a diagram showing a form in which an additional auxiliary device is added to the recording material post-processing device according to Exemplary embodiment 1.
Figure 9:
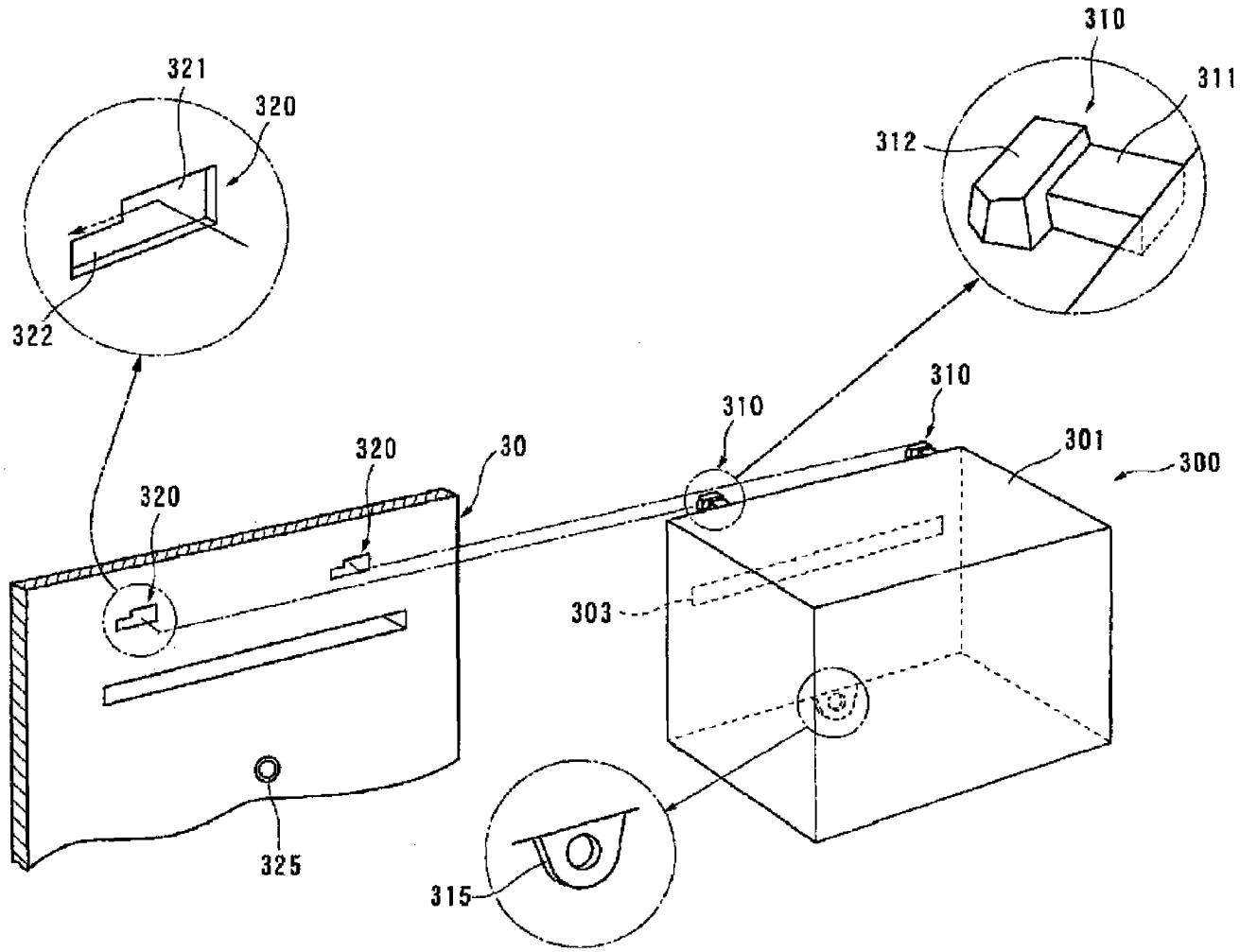
FIG. 9 is a diagram showing an example of an attachment structure of an additional auxiliary device used in exemplary embodiment 1.

In this exemplary embodiment, as shown in FIG. 8, an additional auxiliary device 300 is detachably attached to the outside of the protruded part 31 of the device casing 30 of the image forming device 21.

In this exemplary embodiment, the additional auxiliary device 300 is configured by forming a recording material transporting path 302 inside an additional auxiliary casing 301 and disposing a hole punching mechanism 330 as an additional post-processing device in a part of the recording material transporting path 302.

In this exemplary embodiment, in an upper portion of an attachment side of the additional auxiliary casing 301 for the device casing 30, plural (in this example, two) hooking pieces 310 is formed to protrude, and in the lower part of the attachment side of the additional auxiliary casing 301, an attachment piece 315 that can hold a stopper such as a screw is disposed. In addition, in the device casing 30 to which the additional auxiliary casing 301 is attached, support holes 320 into which the hooking pieces 310 are inserted and hooked are formed, and in a portion corresponding to the attachment piece 315, an attachment hole 325 is formed.

In addition, in the additional auxiliary casing 301, a reception opening 303 for receiving the recording material S is formed.

Particularly in this exemplary embodiment, each hooking piece 310 of the additional auxiliary casing 301 has an insertion piece 311 that protrudes in a direction for insertion into the support hole 320 and a retaining head part 312 that is disposed in the front end portion of the insertion piece 311 and has a cross-section larger than the insertion piece 311. On the other hand, the support hole 320 of the device casing 30 includes an insertion hole part 321, for example, having a rectangular shape into which the hooking piece 310 can be inserted and a hooking and fixing hole part 322, disposed near one side of the insertion hole part 321 to be engaged with the insertion piece 311, into which the retaining head part 312 is hooked to be fixed without being detached in a state that the insertion piece 311 and the hooking and fixing hole part 322 are engaged with each other.

Accordingly, in this exemplary embodiment, for installing the additional auxiliary device 300 to the device casing 30, after the hooking pieces 310 of the additional auxiliary casing 301 are inserted into the support holes 320 of the device casing 30, the hooking pieces are sled to be moved in a horizontal direction, and the stopper (not shown) that is held by the attachment piece 315 of the additional auxiliary casing 301 is attached and fixed to the attachment hole 325 of the device casing 30 in the state. At this moment, the hooking piece 310 of the additional auxiliary casing 300 is hooked and fixed to the support hole 320 of the device casing 30 without missing the support hole 320, and accordingly, the additional auxiliary device 300 is fixed to the device casing 30 without missing the device casing 30.

In addition, for detaching the additional auxiliary device 300 from the device casing 30, the stopper that is not shown in the figure is detached, then the additional auxiliary casing 301 is slightly moved horizontally with respect to the device casing 30, the hooking and fixing state of the hooking piece 310 for the support hole 320 is released, and then the additional auxiliary device 300 is detached from the device casing 30.

Figure 10A:
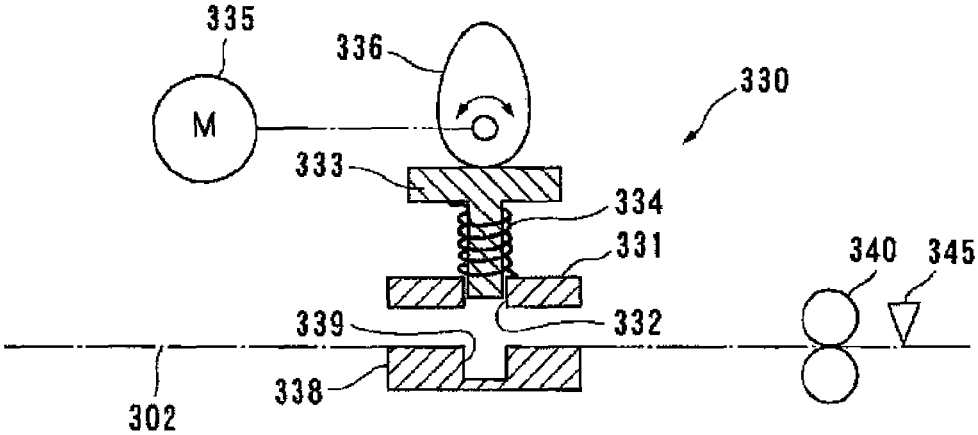
FIGS. 10A and 10B are diagrams showing a hole punching mechanism installed to an additional auxiliary device used in exemplary embodiment 1 and the operation process thereof.
Figure 10B:
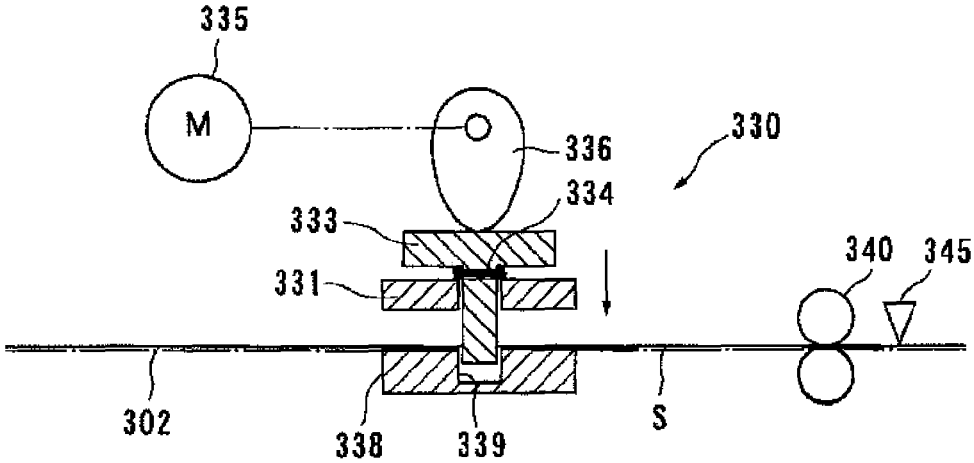

The hole punching mechanism 330 used in this exemplary embodiment is shown in FIG. 10.

In the hole punching mechanism 330 shown in FIG. 10A, a holding member 331 is disposed on the upper side of the recording material transporting path 302, and a reception tray 338 is disposed on the lower side of the recording material transporting path 302. In addition, in the holding member 331, a through hole 332 is formed, a hole punching bar 333 is disposed to be freely inserted or come out into/from the through hole 332, and the hole punching bar 333 is biased upward by the biasing spring 334. In addition, the peripheral side of an eccentric track of an eccentric member 336 that eccentrically rotates in accordance with rotation of the driving motor 335 is pressed to the top portion of the hole punching bar 333, and the hole punching bar 333 is moved vertically in accordance with rotation of the eccentric member 336 while putting up resistance against the biasing spring 334. In addition, in the reception tray 338, a reception hole 339 corresponding to the hole punching bar 333 is disposed.

In addition, in this exemplary embodiment, on the upstream side of the hole punching mechanism 330 in the recording material transporting path 302, a position adjusting roll 340 is disposed to be rotatable in a positive or negative direction. In addition, on the upstream side of the position adjusting roll 340 in the recording material transporting path 302, a position detector 345 is disposed.

A hole punching process by using the hole punching mechanism 330 according to this exemplary embodiment, is performed as stated below. With reference to a time point when the front end position of the recording material S is detected by the position detector 345 in the recording material transporting path 302, the end portion of the recording material S is brought into contact with the position adjusting roll 340 in a state that the position adjusting roll 340 is stopped temporarily so as to apply skew correction to the recording material S. After the skew correction, the position adjusting roll 340 is stopped again at a time point when the recording material arrives at a hole punching position by controlling the rotation amount of the position adjusting roll 340. And then a hole punching operation is performed by using the hole punching bar 33. In a state that the hole punching process by using the hole punching bar 333 is completed, the position adjusting roll 340 is rotated in a negative direction, so that the recording material S is transported in the original direction for departing from the hole punching mechanism 330.

Figure 11:
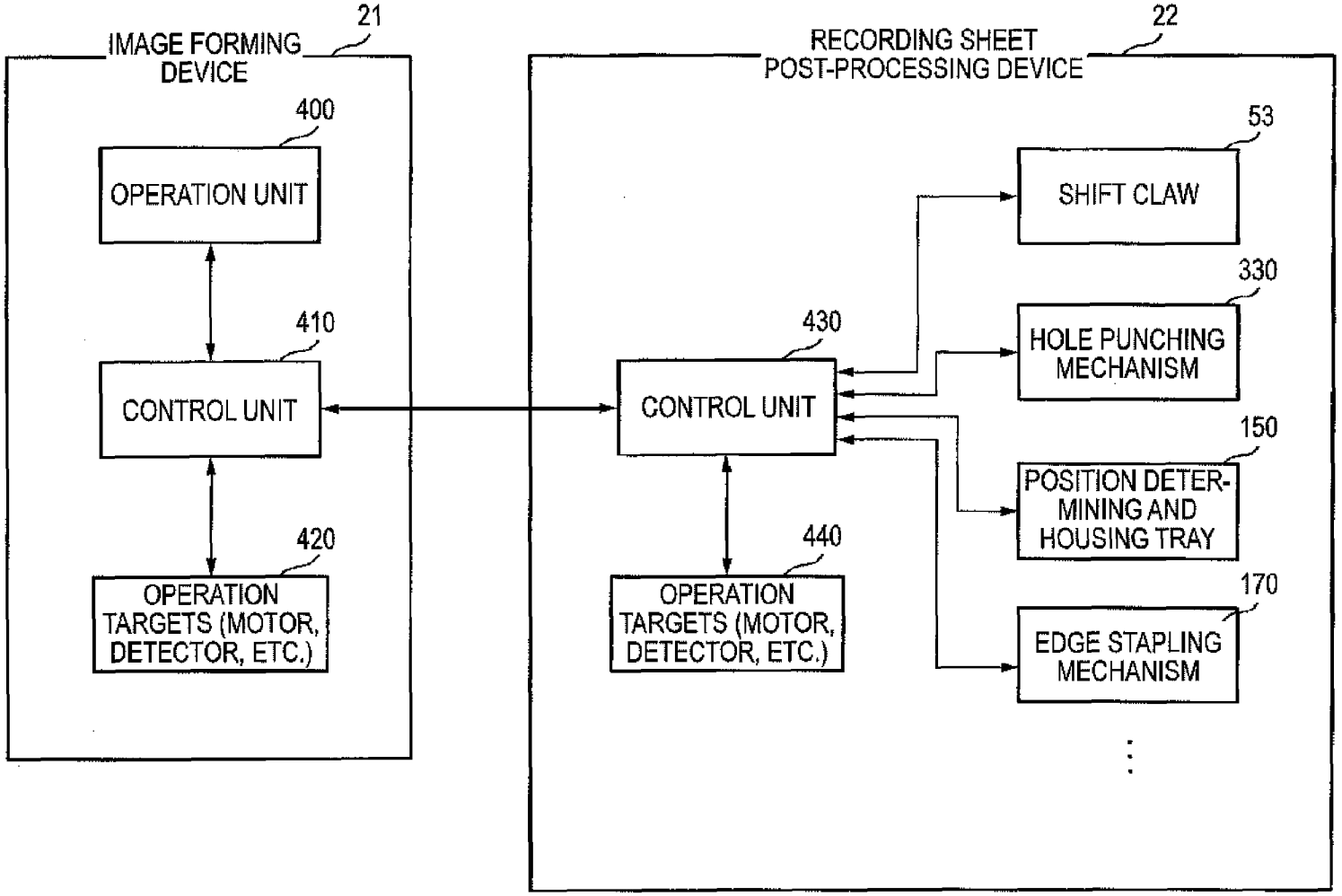
FIG. 11 is a diagram showing a control system used in exemplary embodiment 1.

FIG. 11 shows a control system of a recording material processing apparatus used in this exemplary embodiment.

In the figure, an image forming device 21 has an operation unit 400 that performs an operation for setting the size and number of recording materials S, a hole punching process, a binding mode, or the like and a control unit 410 that controls each operation target (a motor detector or the like) 420 based on information from the operation unit 400.

The recording material post-processing device 22 has a control unit 430 that that exchanges information with the control unit 410 of the image forming device 21. The recording material post-processing device 22 controls a process of shifting the shift claw 53, post-processes of the hole punching mechanism 330 and the edge stapling mechanism 170 which are used as post-process mechanisms, a process for determining the position of the recording material S in the position determining and housing tray 150, and the like, in addition to controlling each operation target (a motor detector or the like) 440 by using the control unit 430.

Next, the operation of a recording material processing apparatus equipped with the additional auxiliary device 300 which is used in this exemplary embodiment will be described.

Figure 12:
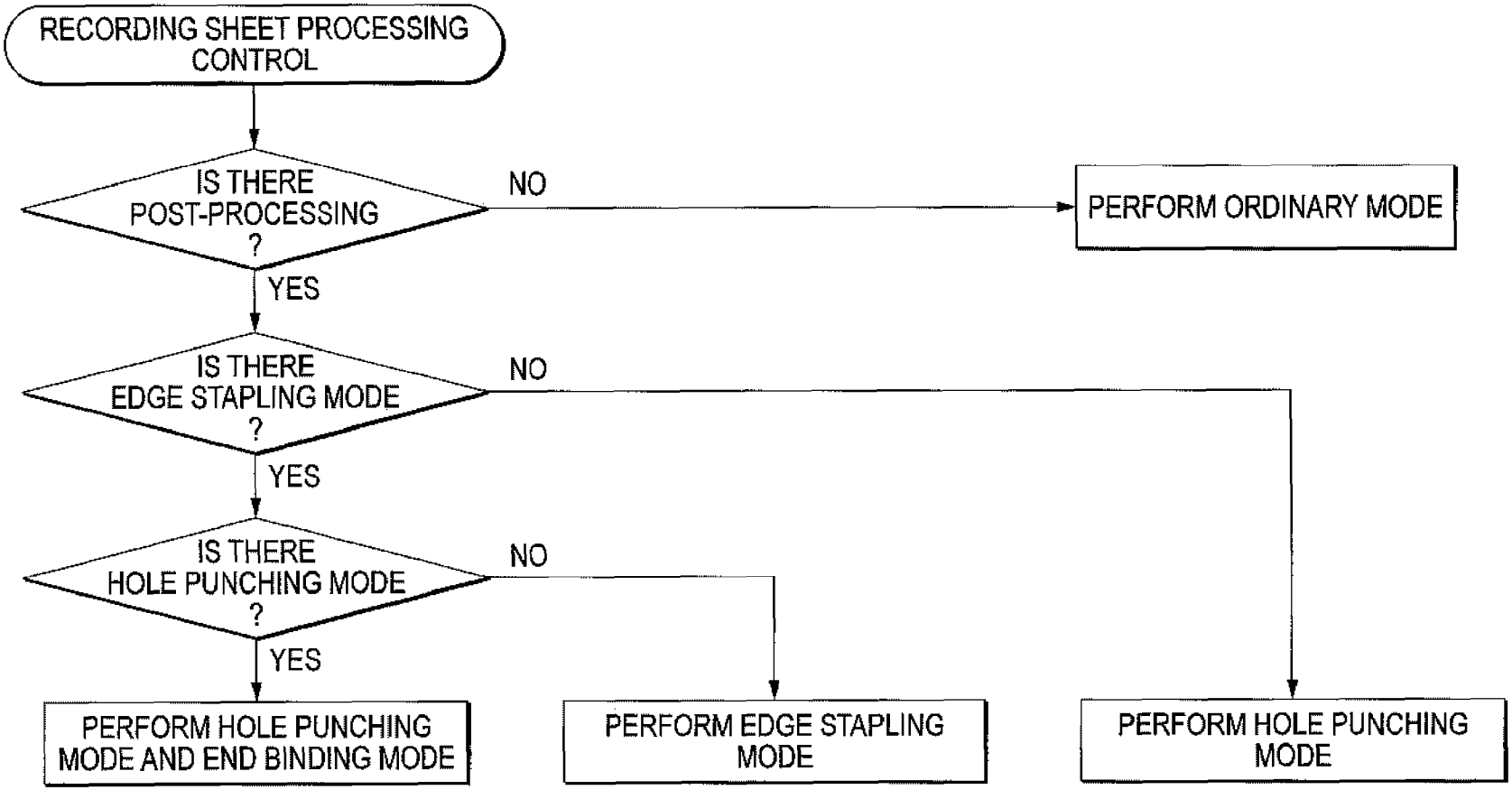
FIG. 12 is a flowchart showing a control process for the recording material in the control system shown in FIG. 11.

In this exemplary embodiment, the control unit 410 of the image forming device 21 and the control unit 430 of the recording material post-processing device 22, as shown in FIG. 12, determine whether a post-process is included, determine whether an edge stapling mode is included as a post-processing and a hole punching mode is included as the post-processing. When the post-process is not included, the control units perform an ordinary mode. Otherwise, the control units perform a hole punching mode and an edge stapling mode, an edge stapling mode (without a hole punching process), or a hole punching mode (without an edge stapling process) based on the mode of the post-process.

A case where the recording material processing apparatus is performed in the ordinary mode will now be described. For example, as shown in FIGS. 3 and 8, when an image is formed on the recording material S, which is supplied from the recording material supplying device 50, by the image forming unit 40, the recording material S for which the image forming process has been completed passes through the fixing device 56 and the branched discharge path 60 and is discharged to the recording material housing tray 61 to be housed.

In this exemplary embodiment, although the recording material S is configured to be discharged to the recording material housing tray 61 in the ordinary mode, however, for example, the recording material may be discharged to the recording material discharging unit 101 to be housed in a state that a post process is not performed by the recording material post-processing device 22.

In such a case, the recording material S for which image creation has been completed by the image forming unit 40 is led to the recording material transporting path 110 of the recording material post-processing device 22 through the branched transport path 52*a*, and passes through the transport roll 116. Then, the position of the recording material S is determined by the position determining and housing tray 150, and the recording material S passes through the discharge roll 117 and is transported to the recording material discharging unit 101 to be discharged.

Next, a case where the recording material processing apparatus performs both the hole punching mode and the edge stapling mode will be described.

Figure 13B:
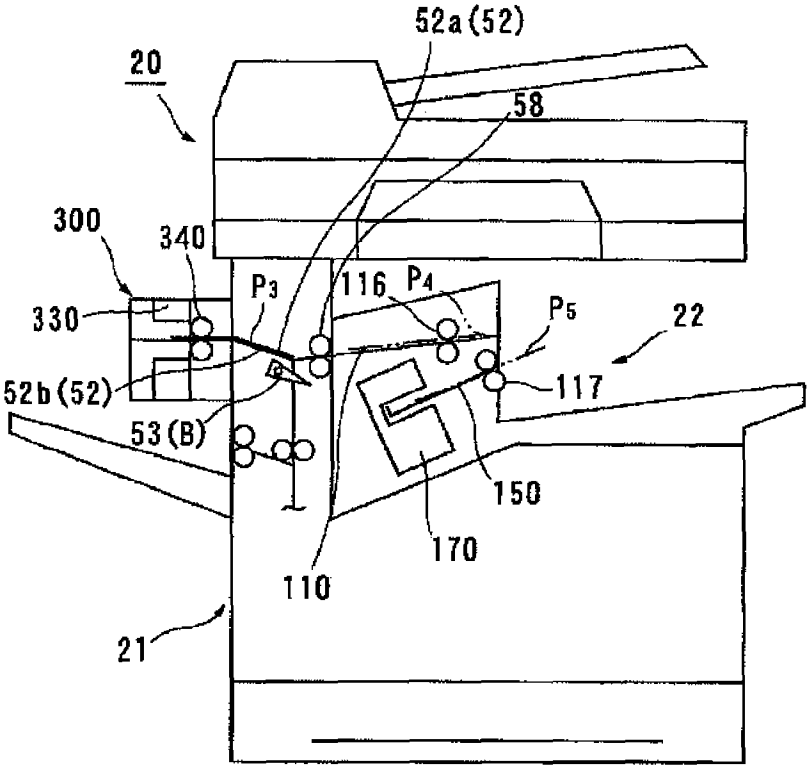
FIGS. 13A and 13B are schematic diagrams showing a recording material post-processing.
Figure 13A:
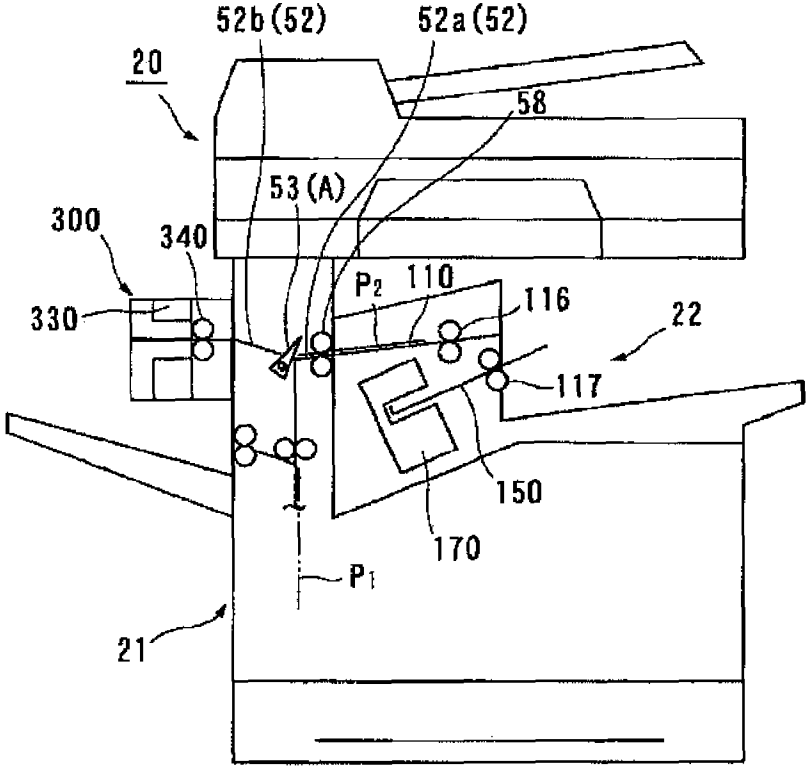

When the hole punching mode and the edge stapling mode are selected by the operation unit 400 of the image forming device 21, the shift claw 53 is shifted to position A shown in FIG. 13A, and one branched transport path 52*a* is selected.

In this state, when an image is formed on the recording material S, which has been supplied from the recording material supplying device 50, by the image forming unit 40, as denoted by $P_1$ and $P_2$ shown in FIG. 13A, the recording material S for which the image creation has been completed is led to the branched transport path 52*a* side through the fixing device 56. When a condition that the rear end of the recording material S passes through the branching position of the branched transport path 52 is achieved, the recording materials S is stopped temporarily in a state that it is nipped by the discharge roll 58.

Thereafter, the discharge roll 58 is rotated in the negative direction and the shift claw 53 changes to a position for connecting the branched transport paths 52 (52*a* and 52*b*) on both sides by being shifted to position B. Then, the recording material S led to one branched transport path 52*a*, as denoted by $P_3$ shown in FIG. 13B, is transported to the other branched transport path 52*b* by a switching back operation, and then transported to the additional auxiliary device 300.

Thereafter, in the additional auxiliary device 300, a hole punching process for an end portion of the recording material S in the forward direction is performed by the hole punching mechanism 330. Then, the recording material S for which the hole punching process has been performed is returned to the original branched transport paths 52*b* and 52*a* from the additional auxiliary device 300. Then, the recording material S, as denoted by $P_4$ shown in FIG. 13B, is led to the recording material transporting path 110 of the post-processing device casing 100 of the recording material post-processing device 22.

Then, when the recording material S passes through the transport roll 116, the position of the recording material S is determined by the position determining and housing tray 150, and in this state, the edge stapling process is performed by the edge stapling mechanism 170. Thereafter, the recording material S is transported from the position determining and housing tray 150 to the recording material discharging unit 101 to be discharged by the discharge roll 117.

When the edge stapling mode (without hole punching) is selected by the operation unit 400 of the image forming device 21, the shift claw 53 is shifted to position A so as to select one branched transport path 52*a*. The recording material S for which image creation has been completed by the image forming unit 40 passes through the fixing device 56, and then is led to the recording material post-processing device 22 through the one branched transport path 52*a*.

Thereafter, the position of the recording material S, as denoted by $P_4$ and $P_5$ shown in FIG. 13B, is determined by the position determining and housing tray 150, and then the edge stapling process is performed for the recording material by the edge stapling mechanism 170. Then, the recording material S is transported by the discharge roll 117 to the recording material discharging unit 101 to be discharged.

When the hole punching mode (without edge stapling) is selected by the operation unit 400 of the image forming device 21, as denoted by $P_1$ and $P_2$ shown in FIG. 13A, the shift claw 53 is shifted to position A so as to select one branched transport path 52*a*. Then, the recording material S for which image creation has been completed by the image forming unit 40 passes through the fixing device 56 and the one branched transport path 52*a* and is stopped in a state that one end of the recording material is nipped by the discharge roll 58.

Thereafter, the discharge roll 58 is rotated in the negative direction and the shift claw 53 changes to a position for connecting the branched transport paths 52 (52*a* and 52*b*) on both sides by being shifted to position B. Then, the recording material S led to one branched transport path 52*a*, as denoted by $P_3$ shown in FIG. 13B, is transported to the other branched transport path 52*b* by a switching back operation, and then is transported to the additional auxiliary device 300. Then a hole punching process by using the hole punching mechanism 330 is performed for the recording material.

Thereafter, the recording material S having a drilled hole is led to the recording material post-processing device 22 through the original branched transport paths 52 (52*a* and 52*b*) from the additional auxiliary device 300. Then, the position of the recording material S is determined by the position determining and housing tray 150, and the recording material S is transported by the discharge roll 117 to the recording material discharging unit 101 to be discharged without performing an edge stapling process using the edge stapling mechanism 170.

In this exemplary embodiment, a case where the recording material post-processing device 22, as shown in FIG. 8, is equipped with the additional auxiliary device 300 has been described. However, for example, for a user who does not need the additional auxiliary device 300, as shown in FIG. 3, a recording material post-processing device 22 having a standard equipment specification in a state that the additional auxiliary device 300 is detached is used, and the edge stapling process by using the edge stapling mechanism 170 is performed as a post-process.

The above description also applies to the following exemplary embodiments.

Figure 14:
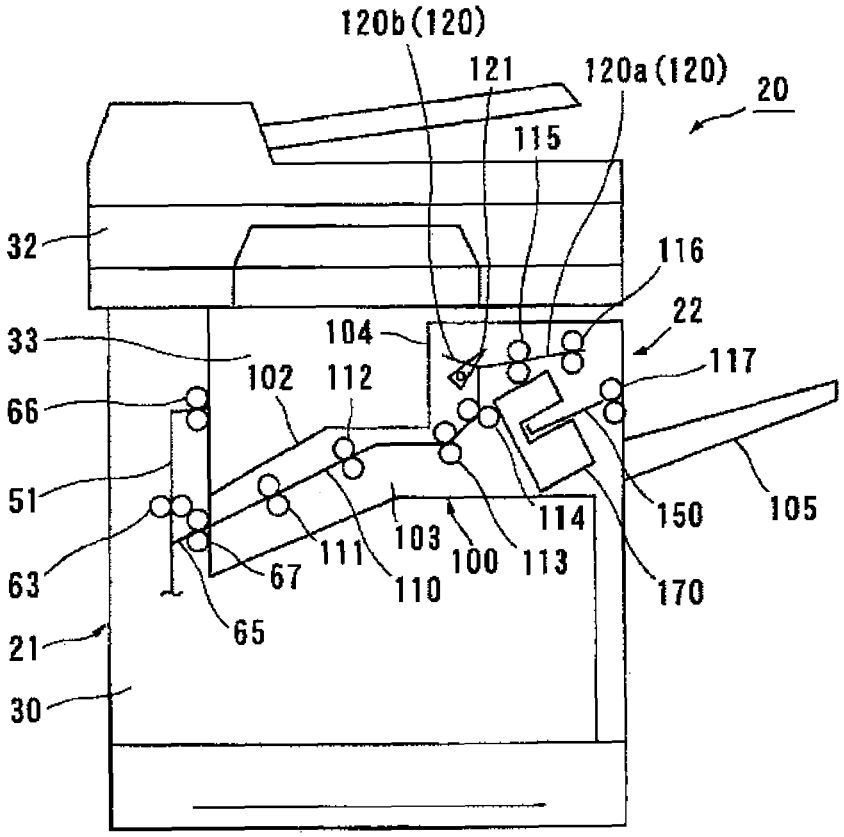
FIG. 14 is a diagram showing the whole configuration of a recording material processing apparatus according to exemplary embodiment 2.

FIG. 14 shows an overview of a recording material processing apparatus according to exemplary embodiment 2.

In the figure, the recording material processing apparatus 20, similarly to exemplary embodiment 1, includes an image forming device 21 that forms an image on a recording material S and a recording material post-processing device 22 that performs a post-process for the recording material S for which the image has been formed by the image forming device 21.

In this exemplary embodiment, in the image forming device 21, different from that in exemplary embodiment 1, one branched transport path 65 that is branched in the middle of a recording material transporting path 51 of the device casing 30 is included and discharge rolls 66 and 67 are disposed in exits of the recording material transporting path 51 and the branched transport path 65. In the image forming device 21, the recording material S is led to a recording material post-processing device 22 through the branched transport path 65, and is led to a recording material discharging unit 102 disposed in the top portion of a post-processing device casing 100 of the recording material post-processing device 22 through the recording material transporting path 51.

On the other hand, the recording material post-processing device 22 having a standard equipment specification has a post-processing device casing 100 that is housed in a concave portion 33 of the device casing 30 of the image forming device 21. In addition, the post-processing device casing 100 includes a horizontal casing 103 that extends in an approximately horizontal direction with respect to the concave portion 33 and a protruded casing 104 that protrudes upward from a part of the horizontal casing 103 near the outside of the concave portion 33. In addition, in a portion of the horizontal casing 103 which is located in an end portion of the outer side of the concave portion 33, a recording material housing tray 105 to which the recording material S can be transported and discharged is disposed.

Inside the post-processing device casing 100, the recording material transporting path 110 is disposed. The recording material transporting path 110 is configured as branched transport paths 120 (for example, 120*a* and 120*b*) branched in two near the protruded casing 104. One branched transport path 120*a* extends toward a part of the protruded casing 104 which is located on the outer side (the right side in the figure) of the concave portion 33, and transport rolls 115 and 116 are disposed in the branched transport path 120*a*. In addition, the other branched transport path 120*b* extends toward a part of the protruded casing 104 which is located on the inner side (the left side in the figure) of the concave portion 33 and is disposed up to a position facing the outer side of the protruded casing 104. In addition, a shift claw 121 is disposed in the branching position of the branched transporting path 120. The shift claw 121 is configured to be shifted between a position (position A) for selecting one branched transport path 120*a* and a position (position B) for connecting both the branched transport paths 120*a* and 120*b* together.

Below the one branched transport path 120*a* of the protruded casing 104, a position determining and housing tray 150 and an edge stapling mechanism 170 that binds the end portion of the recording material S positioned in the position determining and housing tray 150 are disposed. The recording material S positioned in the position determining and housing tray 150 is configured to be transported and discharged to the recording material housing tray 105 through the discharge roll 117.

Figure 15:
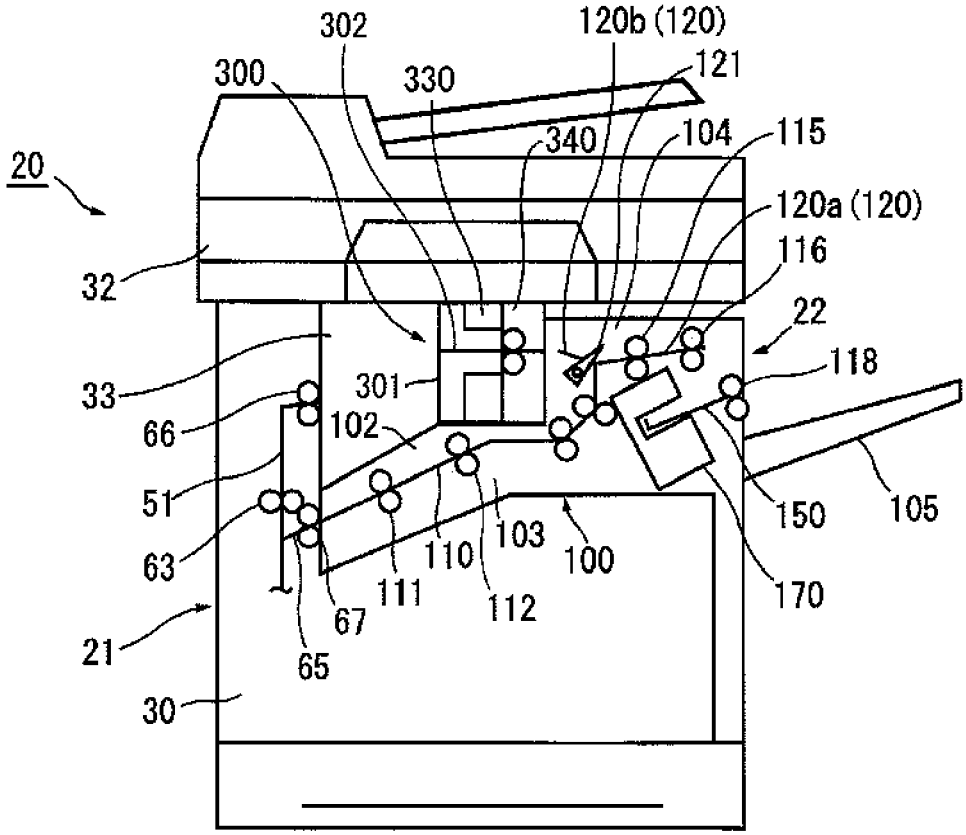
FIG. 15 is a diagram showing a form in which an additional auxiliary device is added to a recording material post-processing device according to exemplary embodiment 2.

In this exemplary embodiment, as shown in FIG. 15, the recording material post-processing device 22 is configured by detachably attaching an additional auxiliary device 300 to the inner side of the concave portion 33 of the protruded casing 104 of the post-processing device casing 100.

The additional auxiliary device 300 is, similarly to that in exemplary embodiment 1, configured by forming a recording material transporting path 302 inside an additional auxiliary casing 301, disposing a hole punching mechanism 330 in a part of the recording material transporting path 302, and disposing a position adjusting roll 340 on the upstream side of the hole punching mechanism 330 in the recording material transporting path 302. In addition, the attachment structure of the additional auxiliary device 300 that can be detachably attached is approximately the same as that in exemplary embodiment 1.

In this exemplary embodiment, a control unit 410 of the image forming device 21 and a control unit 430 of the recording material post-processing device 22 are approximately the same as those in exemplary embodiment 1. The control units 410 and 430 are configured to control a shift claw 121, a hole punching mechanism 330, a position determining and housing tray 150, an edge stapling mechanism 170, and the like and perform recording material processing modes (an ordinary mode, a hole punching mode and an edge stapling mode, an edge stapling mode, and a hole punching mode) that are approximately the same as those in Exemplary embodiment 1.

Hereinafter, as shown in FIG. 15, various recording material processing modes will be described based on the recording material processing apparatus 20 having the recording material post-processing device 22 that is equipped with the additional auxiliary device 300.

When an ordinary mode is selected by the operation unit 400 of the image forming device 21, the recording material S for which an image has been created by the image forming unit 40 is moved in the recording material transporting path 51 through the fixing device 56 and is transported and discharged by the discharge roll 66 from the exit of the recording material transporting path 51 to the recording material discharging unit 102 that is disposed in the top portion of the post-processing device casing 100.

When the hole punching mode and the edge stapling mode are selected by the operation unit 400 of the image forming device 21, the recording material S for which the image creation has been completed by the image forming unit 21 is led to the recording material post-processing device 22 through the branched transporting path 65 by the discharge roll 67 and is transported through the recording material transporting path 110 inside the post-processing device casing 100.

At this moment, since the shift claw 121 of the branched transport path 120 is shifted to a position (position A) for selecting one branched transport path 120*a*, the recording material S is lead to the one branched transport path 120*a* side, and is temporarily stopped at a time point when the rear end of the recording material S passes the branching position of the branched transport path 120.

Thereafter, for example, the shift claw 121 is shifted to a position (position B) for connecting both the branched transport paths 120*a* and 120*b* together. Then by rotating the discharge rolls 115 and 116 in the reverse direction, the recording material S is transported to the other branched transporting path 120*b* and then led to the additional auxiliary device 300. For the recording material S, a hole punching process is performed by the hole punching mechanism 330 of the additional auxiliary device 300.

Then, the recording material S for which the hole punching process is performed by the additional auxiliary device 300 is transported through the branched transport paths 120 (120*a* and 120*b*), and then is positioned and housed in the position determining and housing tray 150. Next, the edge stapling process is performed by the edge stapling mechanism 170 for the recording material, and the recording material S is transported and discharged to the recording material housing tray 105 by the discharge roll 117.

When the hole punching mode (without edge stapling) is selected by the operation unit 400 of the image forming device 21, operations for the above-described hole punching mode and the edge stapling mode process except for the edge stapling process using the edge stapling mechanism 170 are performed.

In addition, when the edge stapling mode (without hole punching) is selected by the operation unit 400 of the image forming device 21, operations for the above-described hole punching mode and the edge stapling mode process except for the hole punching process using the hole punching mechanism 330 of the additional auxiliary device 300 are performed.

Figure 16:
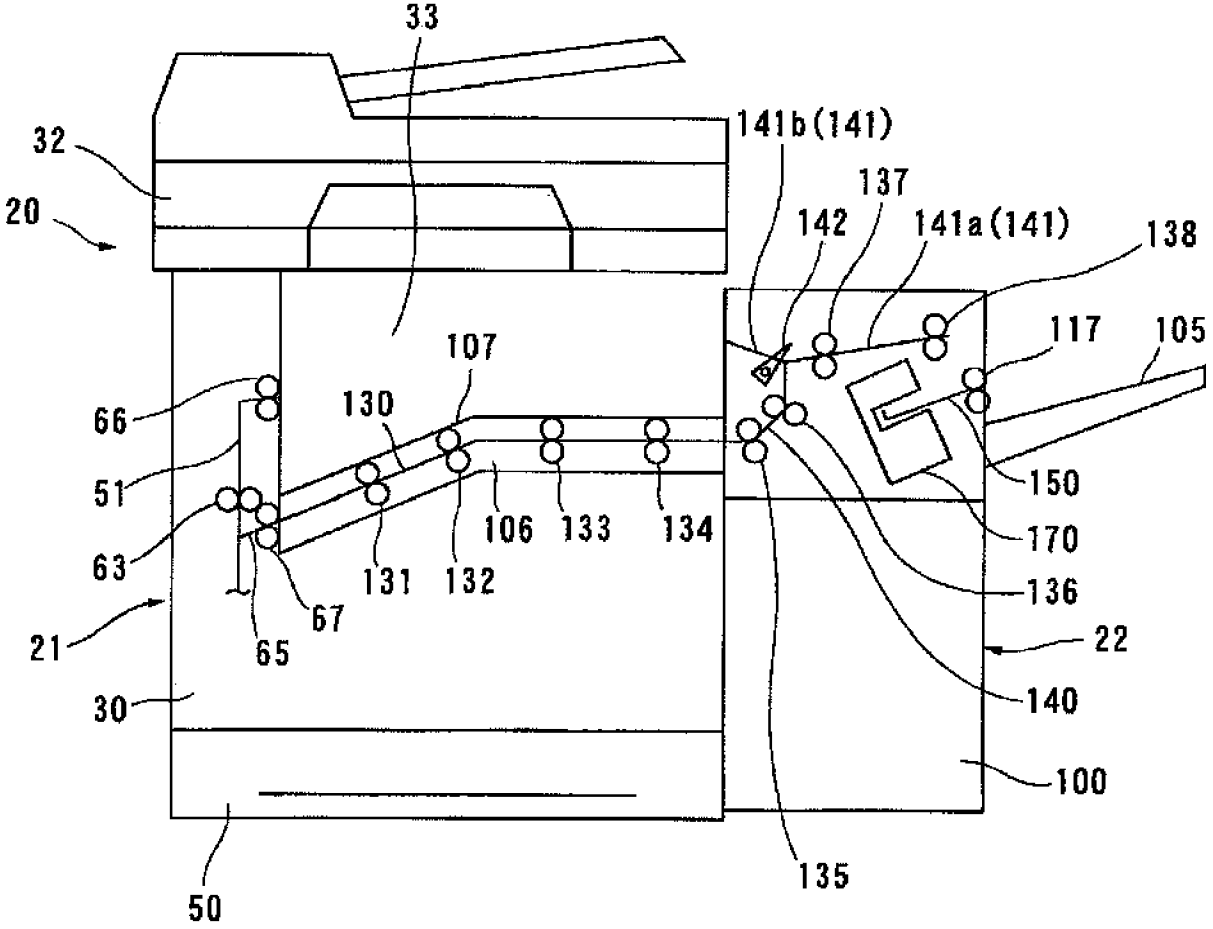
FIG. 16 is a diagram showing the whole configuration of a recording material processing apparatus according to exemplary embodiment 3.

FIG. 16 shows an overview of a recording material processing apparatus according to exemplary embodiment 3.

In the figure, the recording material processing apparatus 20, similarly to exemplary embodiment 1, includes an image forming device 21 that forms an image on a recording material S and a recording material post-processing device 22 that performs a post-process for the recording material S for which the image is formed by the image forming device 21.

In this exemplary embodiment, the image forming device 21 is approximately the same as that of exemplary embodiment 2. To a same constituent element as that of exemplary embodiment 2, a same reference numeral as that of exemplary embodiment 2 is assigned, and a detailed description thereof is omitted here.

The recording material post-processing device 22 of a standard equipment specification has a post-processing device casing 100 that is installed along the side of the device casing 30 of the image forming device 21. In addition, a recording material transporting casing (a transport unit) 106 is disposed on the bottom of the concave portion 33 of the device casing 30, and the recording material S for which the image creation has been completed by the image forming device 21 is led to the post-processing device casing 100 through the recording material transporting casing 106.

In addition, the top portion of the recording material transporting casing 106 is configured to be operated as a recording material discharging unit 107 located inside the concave portion 33 of the device casing 30.

Here, the recording material transporting casing 106 has a recording material transporting path 110, and plural transport rolls 131 to 134 is disposed in the recording material transporting path 130.

The post-processing device casing 100 is installed toward a position facing the outer side of the concave portion 33 of the device casing 30. Inside the post-processing device casing 100, a recording material transporting path 140 that is connected to the recording material transporting path 130 of the recording material transporting casing 106 is included. In addition, on the outer side of the post-processing device casing 100, a recording material housing tray 105 that can house a discharged recording material S is disposed. In addition, the recording material transporting path 140 is configured in the shape of an approximate letter "T" having a branched transport path 141 (for example, 141*a* and 141*b*) that extends upward from the lower side and is branched in two in the middle thereof. In the branching position of the branched transport path 141, a shift claw 142 for shifting between the branched transport paths 141 is disposed.

Here, in the recording material transporting path 140 located in front of the branched transport path 141, plural transport rolls 135 and 136 are disposed. In addition, in one branched transport path 141*a*, plural transport rolls 137 and 138 are disposed.

Below the one branched transport path 141*a*, a position determining and housing tray 150 is disposed, and an edge stapling mechanism 170 that binds an end portion of the recording material S positioned in the position determining and housing tray 150 is provided. The recording material S positioned in the position determining and housing tray 150 is configured to be transported and discharged to the recording material housing tray 105 through the discharge roll 117.

Figure 17:
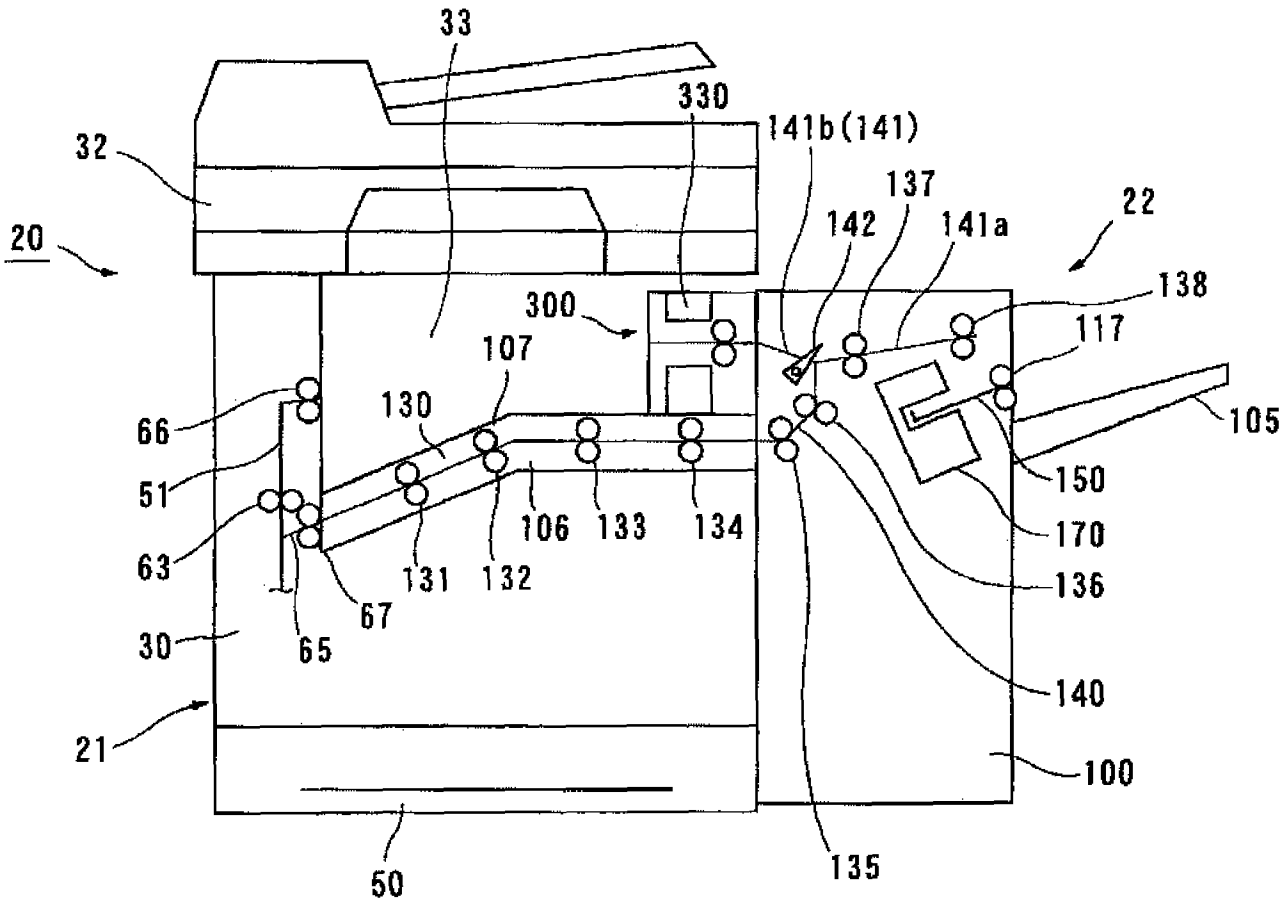
FIG. 17 is a diagram showing a form in which an additional auxiliary device is added to a recording material post-processing device according to exemplary embodiment 3.

In this exemplary embodiment, as shown in FIG. 17, the recording material post-processing device 22 is formed by detachably attaching an additional auxiliary device 300 to a side facing the concave portion 33 of the device casing 30 of the post-processing device casing 100.

The additional auxiliary device 300 is, similarly to that in exemplary embodiment 1, configured by forming a recording material transporting path 302 inside an additional auxiliary casing 301, disposing a hole punching mechanism 330 in a part of the recording material transporting path 302, and disposing a position adjusting roll 340 on the upstream side of the hole punching mechanism 330 in the recording material transporting path 302. In addition, the attachment structure of the additional auxiliary device 300 that can be detachably attached is approximately the same as that in exemplary embodiment 1.

In this exemplary embodiment, a control unit 410 of the image forming device 21 and a control unit 430 of the recording material post-processing device 22 are approximately the same as those in exemplary embodiment 1. The control units 410 and 430 are configured to control a shift claw 142, a hole punching mechanism 330, a position determining and housing tray 150, an edge stapling mechanism 170, and the like and perform recording material processing modes (an ordinary mode, a hole punching mode and an edge stapling mode, an edge stapling mode, and a hole punching mode) that are approximately the same as those in exemplary embodiment 1.

Hereinafter, as shown in FIG. 17, various recording material processing modes will be described based on the recording material processing apparatus 20 having the recording material post-processing device 22 that is equipped with the additional auxiliary device 300.

When an ordinary mode is selected by the operation unit 400 of the image forming device 21, the recording material S for which an image has been created by the image forming unit 40 is moved in the recording material transporting path 51 through the fixing device 56 and is transported and discharged by the discharge roll 66 from the exit of the recording material transporting path 51 to the recording material discharging unit 107 that is disposed in the top portion of the recording material transporting casing 106.

When the hole punching mode and the edge stapling mode are selected by the operation unit 400 of the image forming device 21, the recording material S for which the image creation has been completed by the image forming device 21 is led to the recording material transporting casing 106 post-processing device 22 through the branched transport path 65 by the discharge roll 67 and then is transported to the post-processing device casing 100.

At this moment, in the recording material post-processing device 22, since the shift claw 142 of the branched transport path 141 is shifted to a position (position A) for selecting the one branched transport path 141*a*, the recording material S is led to the one branched transport path 141*a* side, and is stopped temporarily at a time point when the rear end of the recording material S passes the branching position of the branched transport path 141.

Thereafter, for example, the shift claw 142 is shifted to a position (position B) for connecting both the branched transport paths 141*a* and 141*b* together. And by rotating the discharge rolls 137 and 138 in the reverse direction, the recording material S is transported to the other branched transporting path 141*b* and then led to the additional auxiliary device 300. For the recording material S, a hole punching process is performed by the hole punching mechanism 330 of the additional auxiliary device 300.

Thereafter, the recording material S for which the hole punching process has been performed by the additional auxiliary device 300 is transported through the branched transport paths 141 (141*a* and 141*b*), and then is positioned and housed in the position determining and housing tray 150. Next, the edge stapling process is performed by the edge stapling mechanism 170 for the recording material, and the recording material S is transported and discharged to the recording material housing tray 105 by the discharge roll 117.

When the hole punching mode (without edge stapling) or the edge stapling mode (without hole punching) is selected by the operation unit 400 of the image forming device 21, operations for the above-described hole punching mode and the edge stapling mode process except for the edge stapling process using the edge stapling mechanism 170 or the hole punching process using the hole punching mechanism 330 of the additional auxiliary device 300 are performed.

Figure 18A:
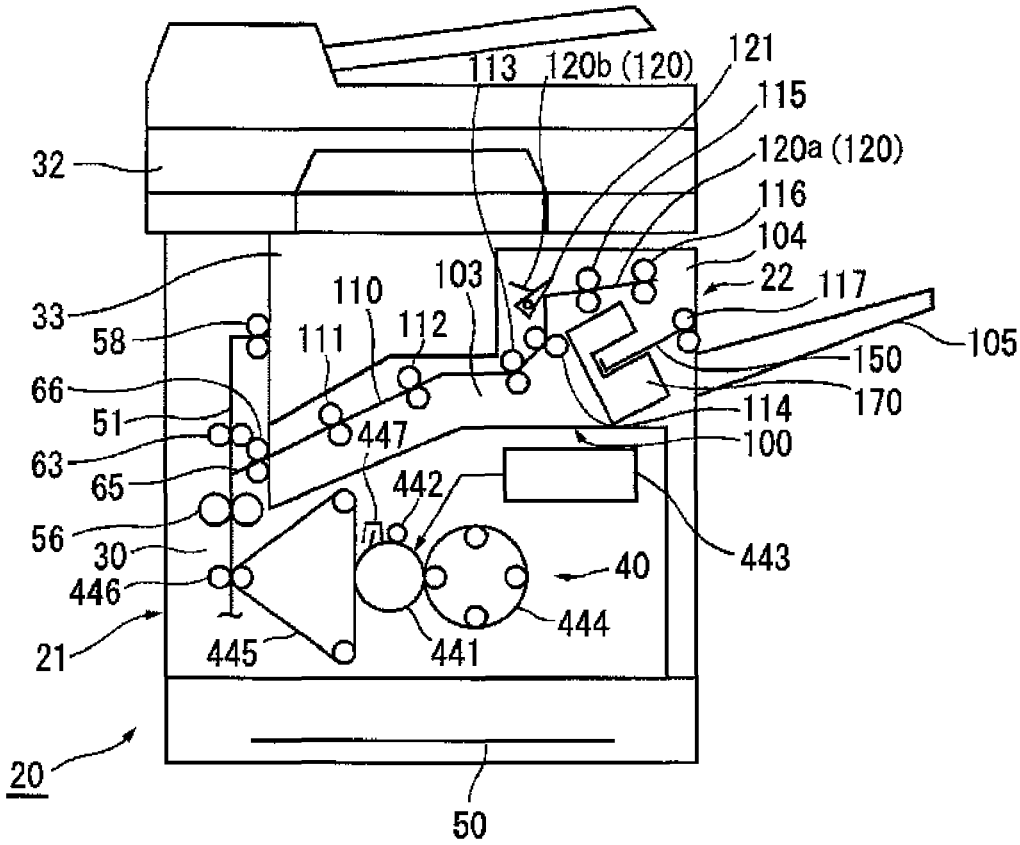
FIG. 18A is a diagram showing the whole configuration of a recording material processing apparatus according to exemplary embodiment 4.

FIG. 18A shows an overview of a recording material processing apparatus according to exemplary embodiment 4.

In the figure, the recording material processing apparatus 20, similarly to exemplary embodiment 2, includes an image forming device 21 that forms an image on a recording material S and a recording material post-processing device 22 that performs a post-process for the recording material S for which the image is formed by the image forming device 21.

In this exemplary embodiment, the image forming device 21 is configured approximately the same as that of exemplary embodiment 2. However, the image forming unit 40, differently from that of exemplary embodiment 2, employs a feature that a color image can be formed by using an intermediate transfer method. To a same constituent element as that of exemplary embodiment 2, a same reference numeral as that of exemplary embodiment 2 is assigned, and a detailed description thereof is omitted here.

In this example, the image forming unit 40 has a photo sensitive drum 441 that forms and maintains a toner image, a charging device 442 such as a charging roller that charges the photoreceptor drum 441, an exposure device 443 such as a laser scanning device that forms a latent image on the charged photoreceptor drum 441, a rotary type developing device 444 that develops the electrostatic latent image formed on the photoreceptor drum 441 by sequentially using toner of each color component into a visible image, an intermediate transfer body 445 on which intermediately toner images of each color component formed on the photo sensitive drum 441 are transferred before the toner images are transferred on a recording material, a transfer device 446 such as a transfer roll that transfers multiple toner images sequentially transferred on the intermediate transfer body 445 to a recording material S supplied from the recording material supplying device 50, and a cleaning device 447 that cleans toner remaining on the photo sensitive drum 41.

A recording material post-processing device 22 of a standard equipment specification is approximately the same as that of exemplary embodiment 2.

Figure 18B:
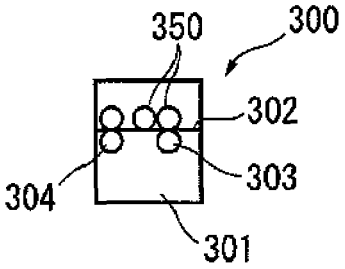
FIG. 18B is a diagram showing an example of an additional auxiliary device.
Figure 18C:
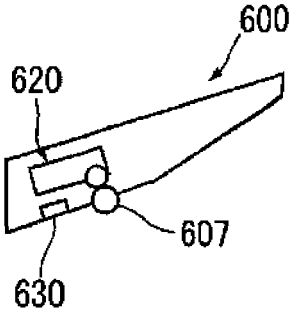
FIG. 18C is a diagram showing an example of an expanded auxiliary device.

Particularly in this exemplary embodiment, in order to add and expand a post-processing function for forming a folding line for the center of the recording material S and then performing a saddle stapling process, the recording material post-processing device 22 uses an additional auxiliary device 300 shown in FIG. 18B and an expanded auxiliary device 600 shown in FIG. 18C.

Figure 19:
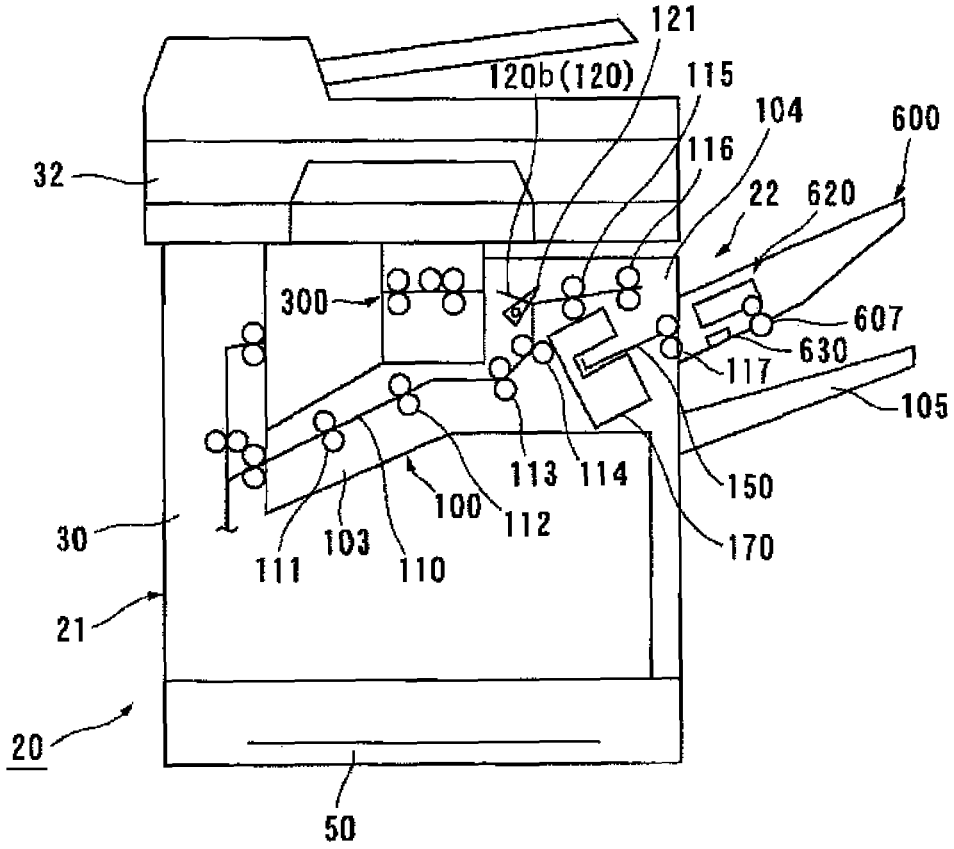
FIG. 19 is a diagram showing a form in which an addition auxiliary device and an expanded auxiliary device are added to a recording material processing apparatus according to Exemplary embodiment 4.

In this exemplary embodiment, as shown in FIGS. 18B and 19, the recording material post-processing device 22 is configured by detachably attaching the additional auxiliary device 300 to the inner side of the concave portion 33 of the protruded casing 104 of the post-processing device casing 100.

In the additional auxiliary device 300, a recording material transporting path 302 is disposed inside the additional auxiliary casing 301, and a folding line mechanism 350 is disposed in a part of the recording material transporting path 302. The attachment structure of the additional auxiliary device 300 that can be detachably attached is approximately the same as that of exemplary embodiment 1.

The folding line mechanism 350 used in this exemplary embodiment is shown in FIG. 20.

Figure 20A:
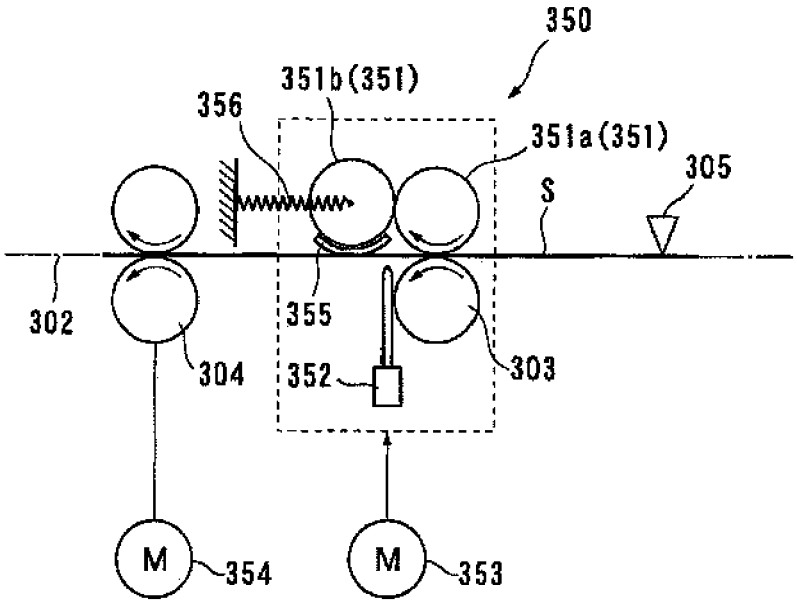
FIG. 20A is a diagram showing a folding line mechanism as an additional post-processing mechanism of an additional auxiliary device used in exemplary embodiment 4 in detail.

In FIG. 20A, the folding line mechanism 350 forms a folding line in a center position of the recording material S in the transport direction for performing a saddle stapling process in the saddle stapling mode. The folding line mechanism 350 includes a pair of folding line rolls 351 (351*a* and 351*b*) for marking a folding line on the recording material S in advance and a folding blade 352 that is disposed on a side opposite to a pinched area of the folding line rolls 351 with respect to the recording material transporting path 302 and can move forward or backward with respect to the pinched area at a given timing.

Here, the folding line roll 351*b* is continuously biased by the one folding line roll 351*a* using a bias spring 356. In addition, on the periphery of the folding line roll 351*b*, a roller cover 355 that can be moved between a position for facing the traveling face of the recording material and a position evacuated from the position for facing the traveling face.

In addition, on the upstream side of the folding line mechanism 350 in the recording material transporting path 302, a position detector 305 used for detecting the front end position of the recording material S is disposed.

Particularly in this exemplary embodiment, one roll 351*a* of the pair of the folding line rolls 351 is disposed to face a transport roll 303 with the recording material transporting path 302 interposed therebetween. In addition, a driving motor 353 is configured to drive the transport roll 303 and the folding line rolls 351 to be rotated in the forward or reverse direction. In addition, a pair of transport rolls 304 located in the downstream side of the folding line mechanism 350 in the recording material transporting path 302 is configured to be driven in the forward or reverse direction by the driving motor 354.

The forward or backward movement of the folding blade 352 may be performed by using an independent driving source. However, in this exemplary embodiment, for example, the folding blade 352 is connected to the driving motor 353 of the folding line roll 351 through a clutch, and the folding blade 352 is configured to be moved forward or backward by using a driving force obtained from the driving motor 353 based on the On/Off operation of the clutch.

Figure 20B:
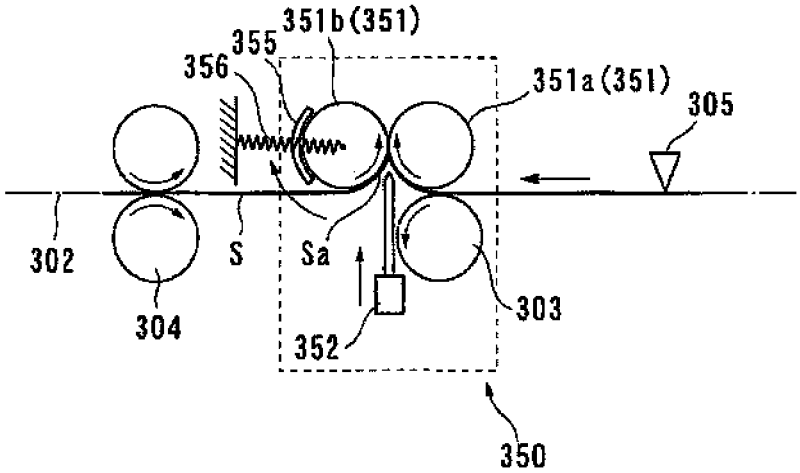
FIG. 20B is a diagram showing a state in a case where a folding line forming operation is performed.

In other words, in this exemplary embodiment, the transport roll 303 and the transport roll 304 are moved by a given amount with reference to the front end position of the recording material S detected by the position detector 305. Then, as shown in FIG. 20B, at a time point when the recording material S reaches a position corresponding to the pinched area of the one pair of the folding line rolls 351, the folding line roll 351 is rotated in a state that the transport roll 304 is rotated in the negative direction by the driving motor 353, and the folding blade 352 is moved forward to the pinched area of the folding line roll 351. Then, a folding line Sa is formed in a center portion of the recording material S while the center portion of the recording material S is led to the pair of the folding line rolls 351. Thereafter, the recording material S pinched between the folding line rolls 351 is turned back in a direction for pulling out the recording material S from the pinched position by rotating the transport roll 303 in the negative direction by the driving motor 353, and the folding blade 352 is returned to its original position. Accordingly, the recording materials S in which the folding lines Sa are formed by the transport rolls 303 and 304 are sequentially transported.

In addition, in this exemplary embodiment, when the transport roll 303 is normally rotated, the roll cover 355 is moved from the evacuation position to the position for facing the traveling side of the recording material, and accordingly, the recording material S is configured not to be brought into contact with the surface of the folding line roll 351*b* rotating in a direction opposite to the transport direction of the recording material S. Thereby, the folding line roll 351*b* is configured not to disturb the transport operation of the recording material S in a case where the folding line is not formed.

In this exemplary embodiment, as shown in FIGS. 18C and 19, the recording material post-processing device 22 is configured by detachably attaching an expanded auxiliary device 600 to the outer side of the protruded casing 104 of the post-processing device casing 100.

Figure 21:
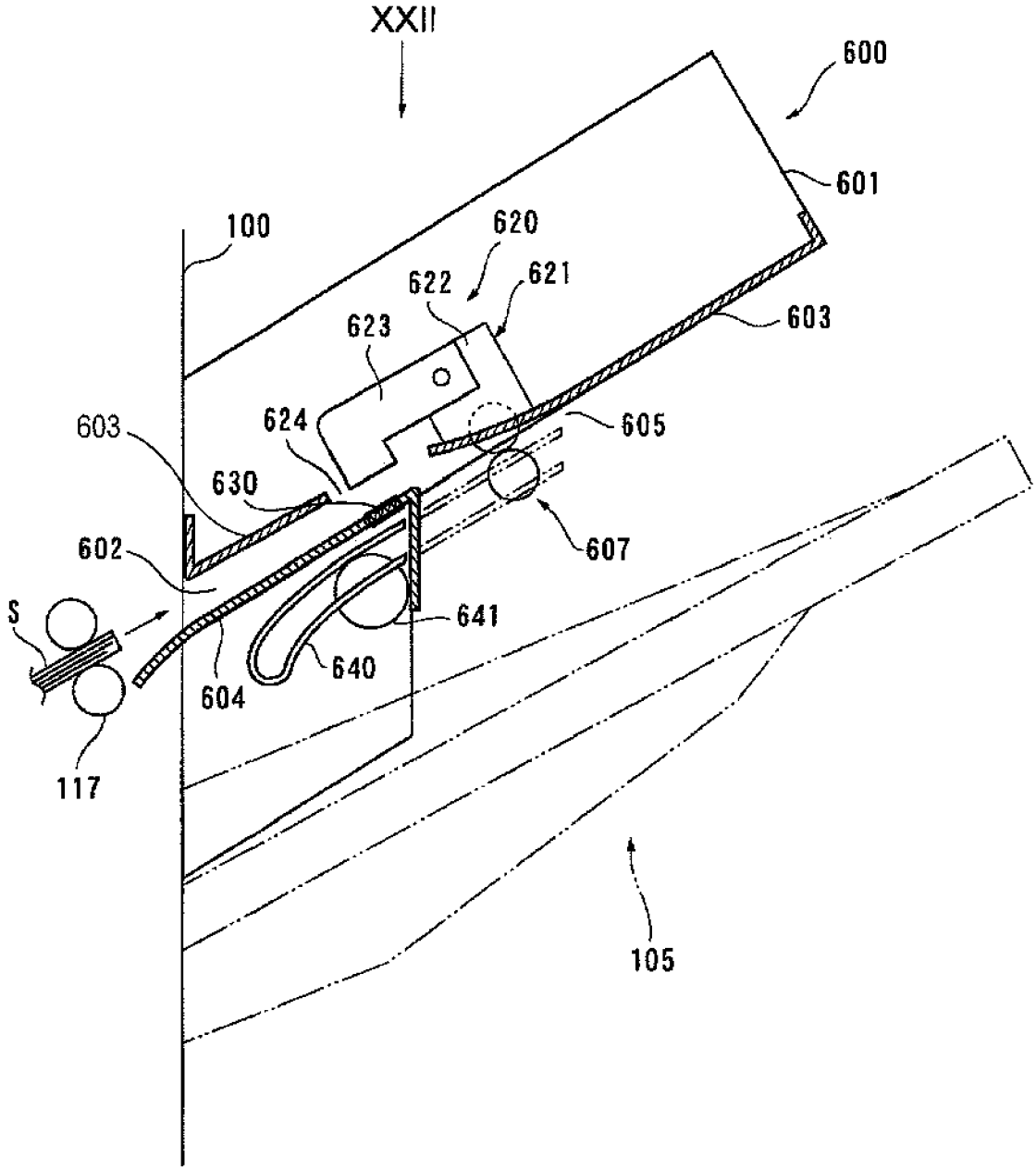
FIG. 21 is a diagram showing a saddle stapling mechanism as an expanded post-processing mechanism of an expanded auxiliary device used in exemplary embodiment 4.

The expanded auxiliary device 600 has a saddle stapling mechanism 620 needed for a binding process. For example, the expanded auxiliary device 600, as shown in FIG. 21, has an expanded auxiliary casing 601 that holds the saddle stapling mechanism 620, a recording material transporting path 602 disposed in the expanded auxiliary casing 601, and an upper partition member 603 and a lower partition member 604 that vertically partition the recording material transporting path 602 (see FIG. 21).

In this exemplary embodiment, the lower partition member 604 is set to have the size of protrusion from the post-processing device casing 100 smaller than the upper partition member 603. A portion below the upper partition member 603 in which the lower partition member 604 does not exist is opened as a discharge opening 605 for discharging the bundle of the recording materials S to the recording material housing tray 105.

In addition, in this exemplary embodiment, below the lower partition member 604, a movable partition member 640 is disposed. The movable partition member 640 forms a gear tooth, not shown in the figure, that is, for example, fitted to a part of the driving gear 641, and is moved so as to appropriately extend approximately along the partition side of the lower partition member 604 in accordance with rotation of the driving gear 641.

Accordingly, when the size of the recording material S is large, the recording material S is supported by the movable partition member 640, and the saddle stapling process by using the saddle stapling mechanism 620 can be performed. The movable partition member 640 is configured to be moved appropriately in accordance with the size of the recording material S.

In addition, the saddle stapling mechanism 620 and a transport roll 607 are installed to the expanded auxiliary casing 601.

Figure 22:
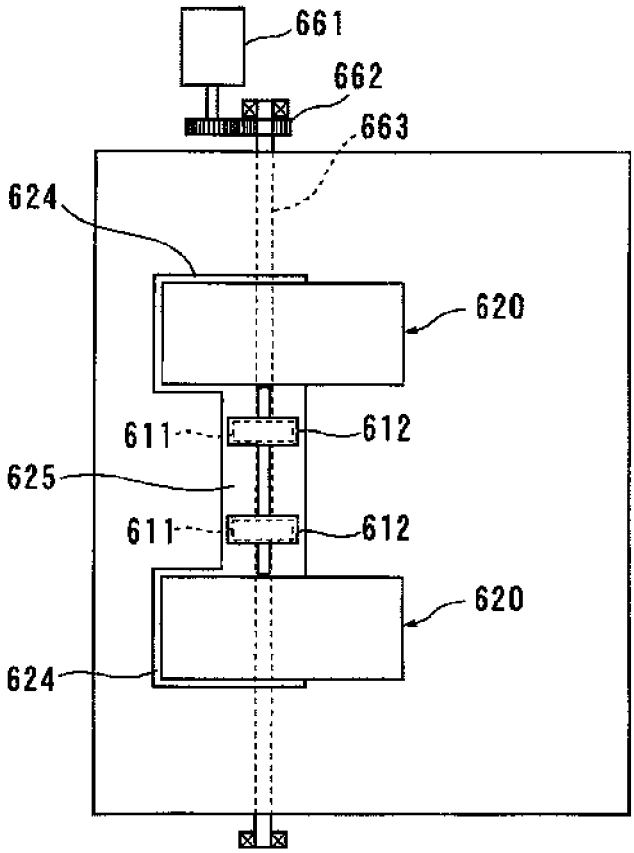
FIG. 22 is a diagram viewed along line XXII shown in FIG. 21.

In this exemplary embodiment, a pair of the saddle stapling mechanisms 620, as shown in FIGS. 21 and 22, is disposed to be fixed in a direction (width direction) perpendicular to the transport direction of the recording material S. Each saddle stapling mechanism 620 is configured to have a saddle stapling mechanism main body 621 that is disposed in the upper partition member 603 and an opposing member 630 that is disposed in a part of the lower partition member 604 so as not to disturb transport of the bundle of the recording materials S.

In this example, the saddle stapling mechanism main body 621 has a support board 622 that is installed to be fixed to the upper partition member 603. In addition, a movable binding unit 623 that is swingable with respect to the support board 622 is disposed. The saddle stapling mechanism main body 621 hammers a binding needle into the bundle of the recording materials S in the recording material transporting path 602 through a hammer opening 624 formed in a part of the upper partition member 603. The movable binding unit 623 has a function for hammering the binding needle. The basic configuration of the movable binding unit 623 is approximately the same as that of the edge stapling mechanism 170.

The opposing member 630 is formed of a hard material and is disposed in correspondence with a saddle stapling position of the movable binding unit 623.

In this exemplary embodiment, one pair of the saddle stapling mechanisms 620 is disposed to be fixed. However, for example, when there is a request for variably setting the saddle stapling position in accordance with the size of the recording material S, the one pair of the saddle stapling mechanisms 620 may be supported by a movable mechanism so as to be moved along the width direction of the recording material S.

The transport roll 607 has a driving roll 611 on its lower side and an attachment/detachment roll 612 on its upper side.

Here, the driving roll 611 as the attachment/detachment mechanism (not shown) of the transport roll 607 transfers the driving force from the driving motor 661 to the support shaft 663 through the drive transfer mechanism 662. The attachment/detachment roll 612 is biased to the driving roll 611 side by a biasing spring not shown in the figure.

In this exemplary embodiment, the transport roll 607 is disposed between the one pair of the saddle stapling mechanisms 620, and both the saddle stapling mechanism are disposed to face each other through a roll opening 625 of the upper partition member 603.

Figure 24A:
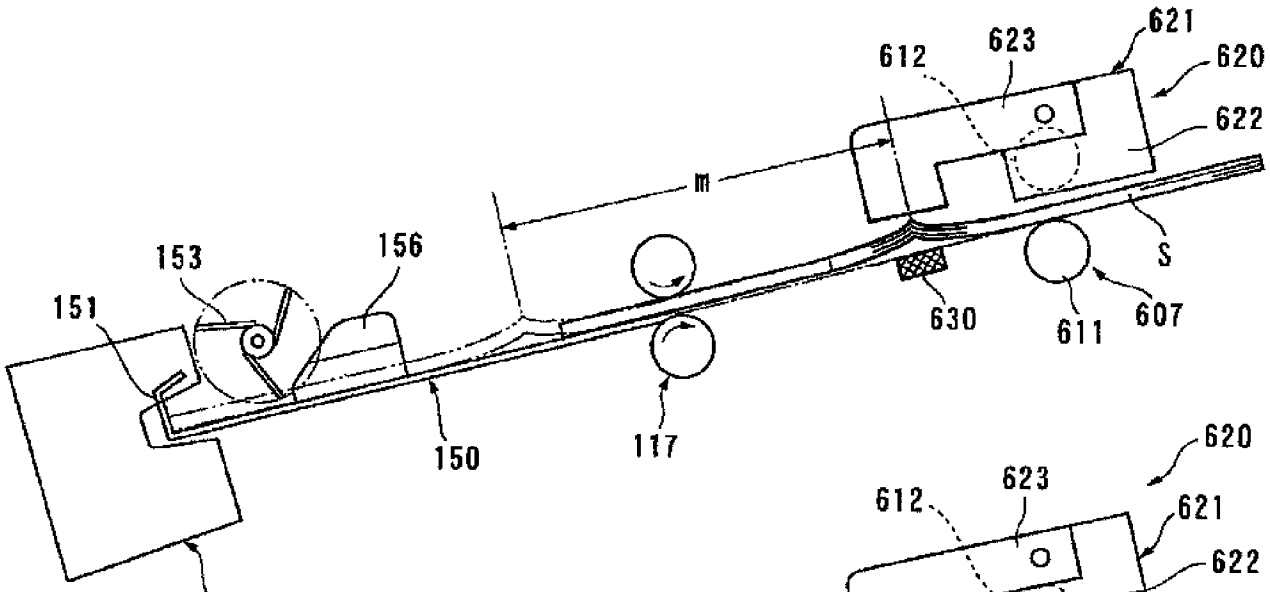
FIGS. 24A and 24B are diagrams showing the operation of a saddle stapling mechanism.
Figure 24B:
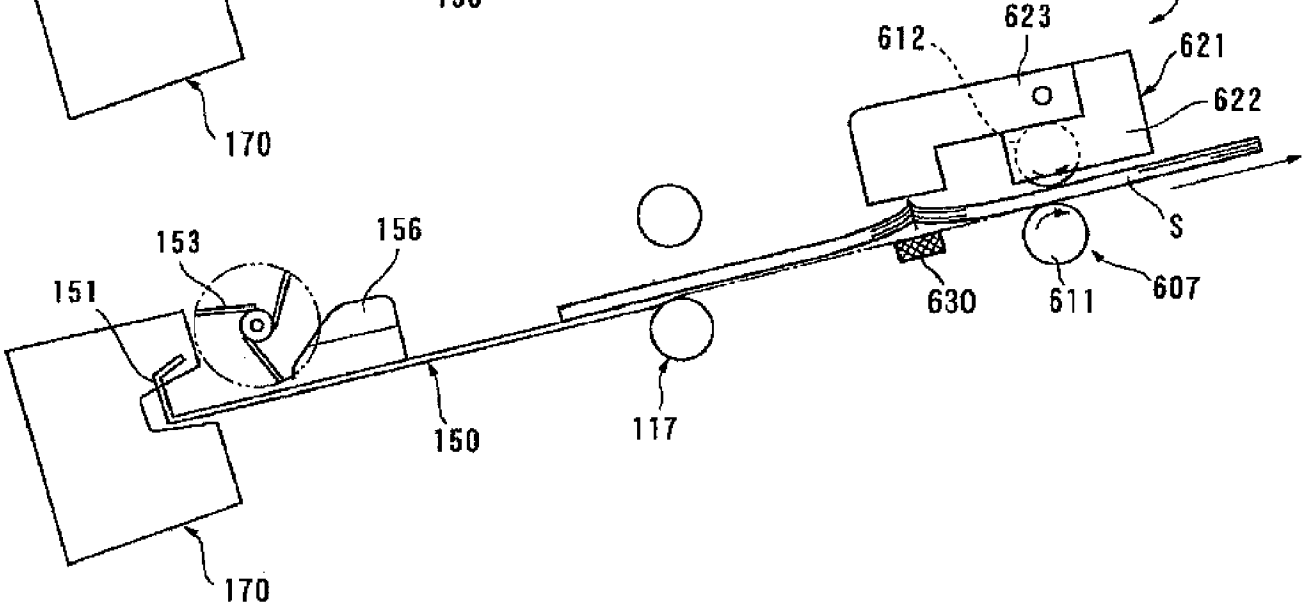

Next, the saddle stapling process by using the saddle stapling mechanism 620 will be described. For example, the saddle stapling process is performed as shown in FIG. 24.

The recording materials S in which a folding line is formed by the folding line mechanism 350 are sequentially discharged to the position determining and housing tray 150.

By the position determining and housing tray 150, the recording material S is positioned and housed in two adjacent directions by the rotation adjusting member 153 and the pressure adjusting member 156.

The above-described operation is repeated a given number of times, and the recording materials S, which are positioned and housed by the position determining and housing tray 150, are pinched by the discharge roll 117 in a state that the recording materials S of a given number are aligned. Thereafter, the recording materials S are transported by a given amount m corresponding to the size of the recording materials S, that is, to a position in which the binding position of the saddle stapling mechanism 620 becomes the center portion of the recording materials S (see FIG. 24A).

Thereafter, the saddle stapling process is performed by the saddle stapling mechanism 620. Then, the recording materials S for which the saddle stapling process has been completed are pinched and transported by the transport roll 607 and are housed in the recording material housing tray 105 (see FIG. 24B). When the recording materials S are pinched and transported by the transport roll 607, the discharge rolls 117 are disposed to be spaced apart from each other in a state that excellent transportability of the bundle of the recoding sheets S is maintained.

Figure 23:
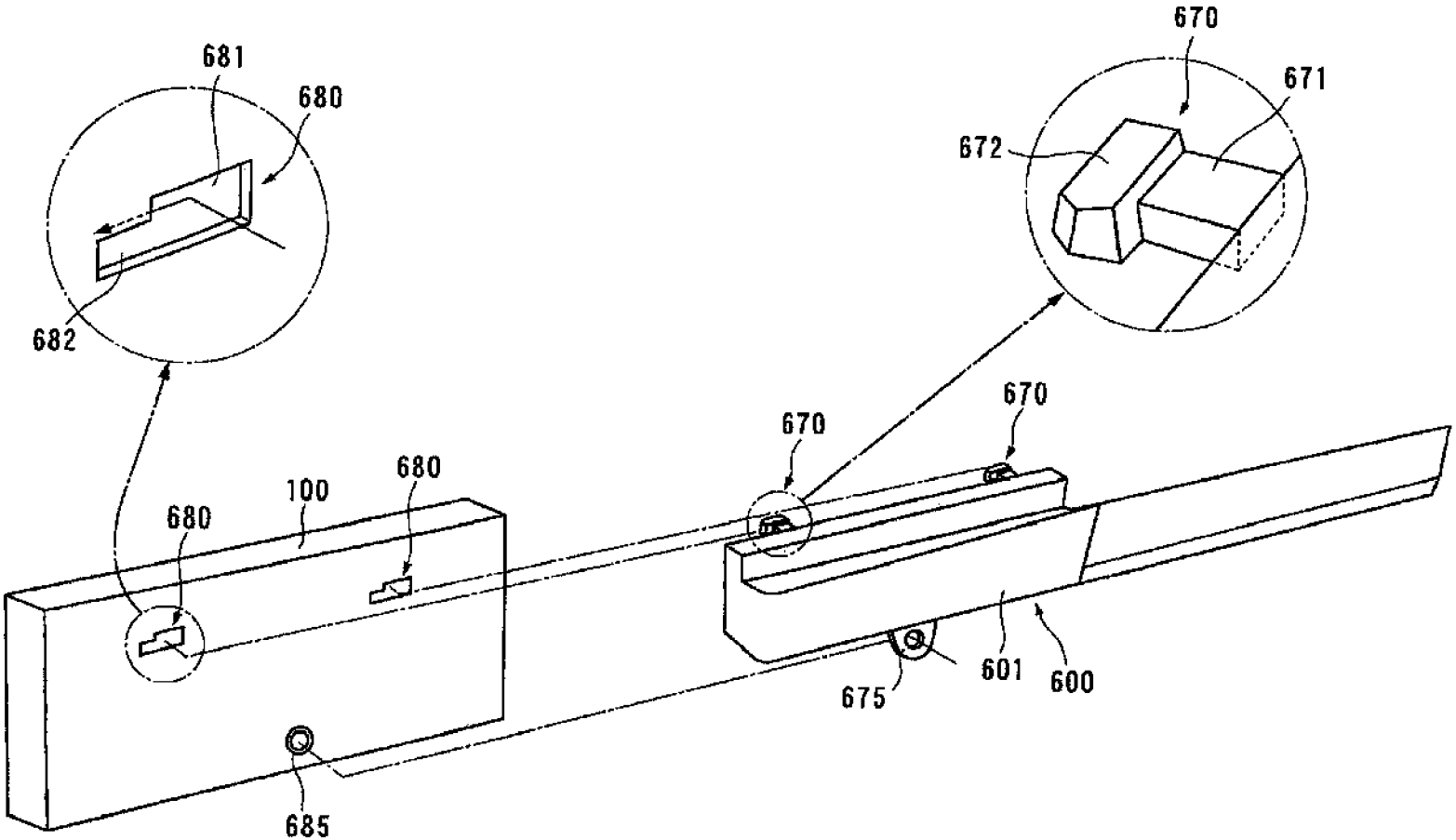
FIG. 23 is a diagram showing an example of an attachment structure of the saddle stapling mechanism shown in FIG. 21.

The attachment structure of the expanded auxiliary device 600 is, for example, shown in FIG. 23.

In the figure, on the upper part of an attachment surface located on the post-processing device casing 100 side of the expanded auxiliary casing 601, plural (in this example, two) of hooking pieces 670 are formed to protrude. On the lower part of the attachment surface of the expanded auxiliary casing 601, an attachment piece 675 in which a stopper such as a screw can be held is disposed. In addition, support holes 680 into which the hooking pieces 670 are inserted and hooked are formed in the post-processing device casing 100, and an attachment hole 685 is disposed in a position corresponding to the attachment piece 675.

Particularly in this exemplary embodiment, each hooking piece 670 of the expanded auxiliary casing 601 has an insertion piece 671 that protrudes in a direction for insertion into the support hole 680 and a retaining head part 672 that is disposed in the front end portion of the insertion piece 671 and has a cross-section larger than the insertion piece 671. On the other hand, the support hole 680 of the post-processing device casing 100 includes an insertion hole part 681, for example, having a rectangular shape into which the hooking piece 670 can be inserted and a hooking and fixing hole part 682, disposed near one side of the insertion hole part 681 to be engaged with the insertion piece 671, into which the retaining head part 672 is hooked to be fixed without being detached in a state that the insertion piece 671 and the hooking and fixing hole part 682 are engaged with each other.

Accordingly, in this exemplary embodiment, for installing the expended auxiliary device 600 to the post-processing device casing 100, after the hooking pieces 670 of the expanded auxiliary casing 601 are inserted into the support holes 680 of the post-processing device casing 100, the hooking pieces are sled to be moved in a horizontal direction, and the stopper (not shown) that is held by the attachment piece 675 of the expanded auxiliary casing 601 is attached and fixed to the attachment hole 685 of the post-processing device casing 100 in the state. At this moment, the hooking pieces 670 of the expanded auxiliary casing 601 is hooked and fixed to the support hole 680 of the post-processing device casing 100 without missing the support hole 680, and accordingly, the expanded auxiliary device 600 is fixed to the post-processing device casing 100 without missing the post-processing device casing 100.

In addition, for detaching the expanded auxiliary device 600 from the post-processing device casing 100, the stopper that is not shown in the figure is detached, then the expanded auxiliary casing 601 is slightly moved horizontally with respect to the post-processing device casing 100, the hooking and fixing state of the hooking piece 670 for the support hole 680 is released, and then the expanded auxiliary device 600 is detached from the post-processing device casing 100.

Figure 25:
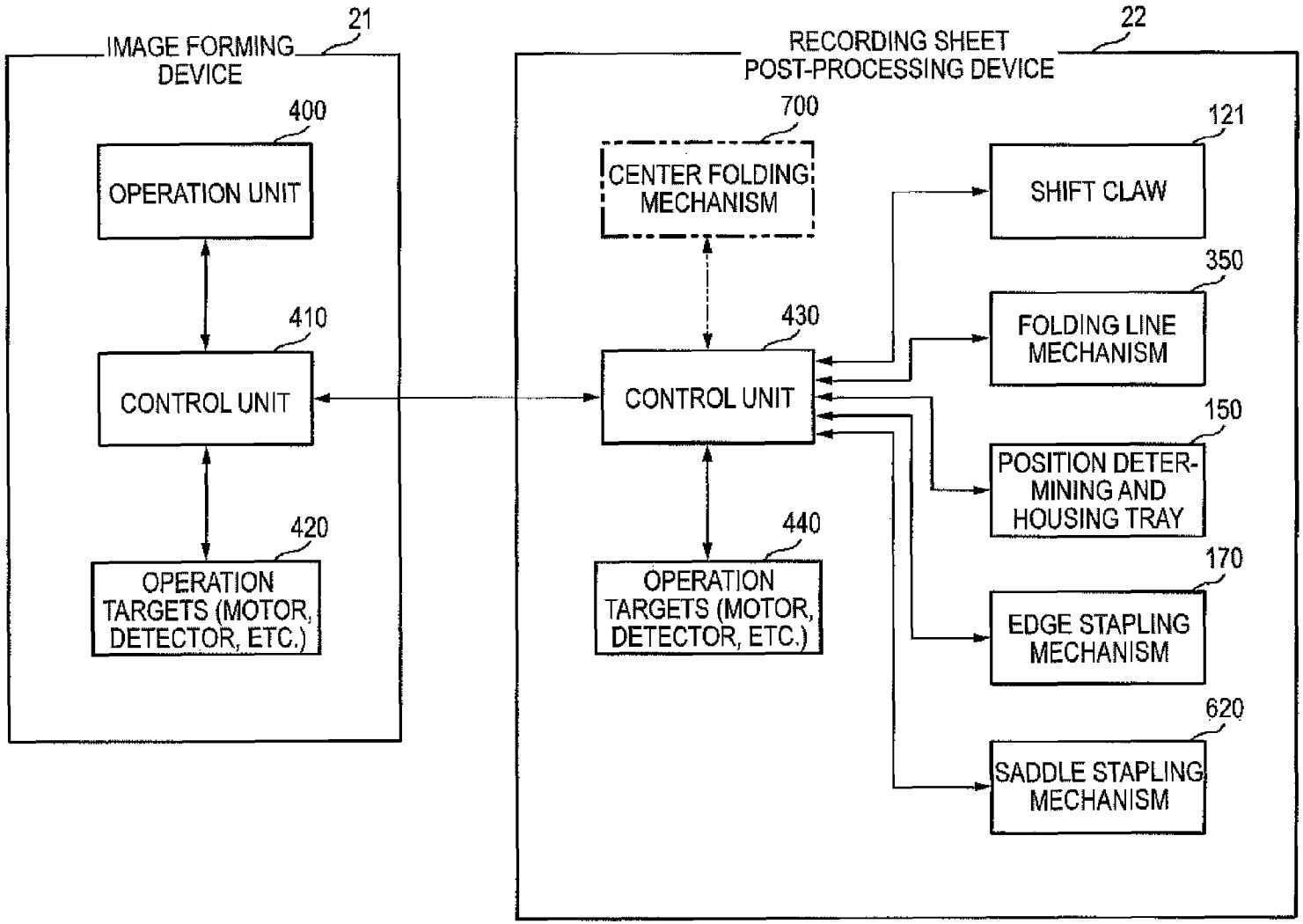
FIG. 25 is a diagram showing a control system used in exemplary embodiment 4.

FIG. 25 shows a control system of a recording material processing apparatus used in this exemplary embodiment.

In the figure, an image forming device 21 has an operation unit 400 that performs an operation for setting the size and number of recording materials S, a hole punching process, a binding mode, or the like and a control unit 410 that controls each operation target (a motor detector or the like) 420 based on information from the operation unit 400.

The recording material post-processing device 22 has a control unit 430 that exchanges information with the control unit 410 of the image forming device 21. The recording material post-processing device 22 controls a process of shifting the shift claw 121, post processes performed by the folding line mechanism 350, the edge stapling mechanism 170, and the saddle stapling mechanism 620 which are used as post-processing mechanisms, a process for determining the position of the recording material in the position determining and housing tray 150, and the like, in addition to controlling each operation target (a motor detector or the like) 440 by using the control unit 430.

Next, the operation of the recording material processing apparatus used in this exemplary embodiment will be described.

Figure 26:
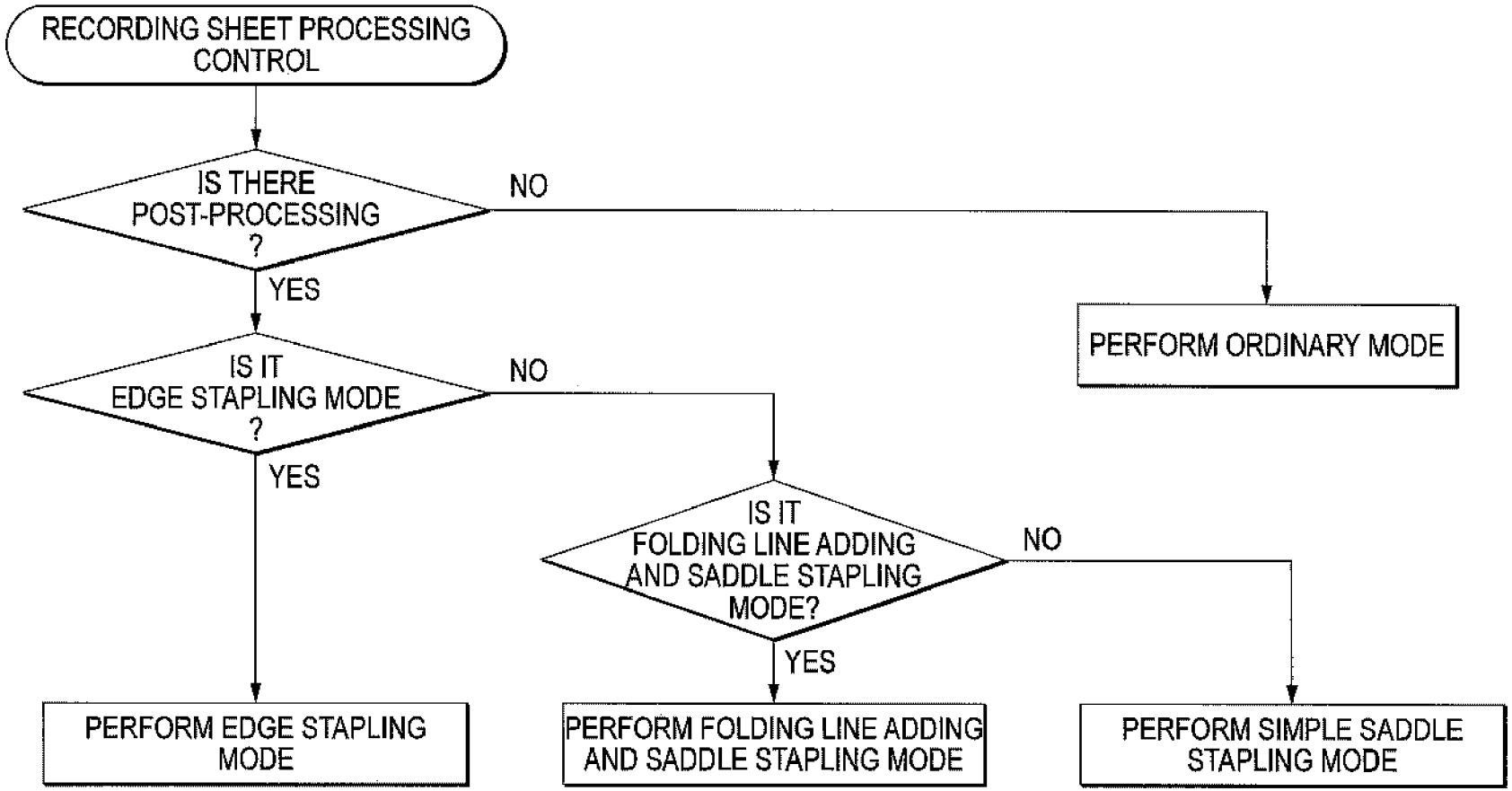
FIG. 26 is a flowchart showing a control process for the recording material in the control system shown in FIG. 25.

In this exemplary embodiment, the control unit 410 of the image forming device 21 and the control unit 430 of the recording material post-processing device 22, as shown in FIG. 26, determine whether a post-process is included and whether the post-process is an edge stapling mode, a folding line adding and saddle stapling mode, or a simple saddle stapling mode. When the post-process is not included, the control units perform an ordinary mode. Otherwise, the control units perform one of the edge stapling mode, the folding line adding and saddle stapling mode, or the simple saddle stapling mode based on the post-processing mode.

A case where the recording material processing apparatus is performed in the ordinary mode will now be described. When an image is formed on the recording material S, which is supplied from the recording material supplying device 50, by the image forming unit 40, the recording material S for which the image forming process has been completed passes through the fixing device 56 and is discharged and housed in the recording material discharging unit 102 through the discharge roll 58.

A case where the recording material processing apparatus performs a folding line adding and saddle stapling mode will be described as follows.

When the folding line mode and the saddle stapling mode are selected by the operation unit 400 of the image forming device 21, as shown in FIG. 19, the recording material S for which the image creation has been completed by the image forming device 21 is led to the recording material post-processing device 22 and is transported along the recording material transporting path 110 by the transport rolls 111 to 114.

At this moment, since the shift claw 121 of the branched transport path 120 is shifted to a position (position A) for selecting the one branched transport path 120*a*, the recording material S is led to the one branched transport path 120*a* side, and is stopped temporarily at a time point when the rear end of the recording material S passes the branching position of the branched transport path 120.

Thereafter, for example, the shift claw 121 is shifted to a position (position B) for connecting both the branched transport paths 120*a* and 120*b* together. And by rotating the discharge rolls 115 and 116 in the negative direction, the recording material S is transported to the other branched transporting path 120*b* and then led to the additional auxiliary device 300. For the recording material S, a folding line process is performed by the folding line mechanism 350 of the additional auxiliary device 300.

Thereafter, the recording material S for which the folding line process has been performed by the additional auxiliary device 300 is transported through the branched transport paths 120 (120*a* and 120*b*), and then is positioned and housed in the position determining and housing tray 150. Next, the recording material S is transported and discharged to the expanded auxiliary device 600 by the discharge roll 117.

In this expanded auxiliary device 600, a saddle stapling process for the end portion of the positioned recording material S to which the folding line has been added is performed by the saddle stapling mechanism 620, and then the recording material S is transported and discharged to the recording material housing tray 105 by the transport roll 607.

In a simple saddle stapling mode, a saddle stapling process by using the saddle stapling mechanism 620 is performed not though the folding line process using the folding line mechanism 350.

When the simple saddle stapling mode (without folding line) is selected by the operation unit 400 of the image forming device 21, the above-described operations of the folding line adding and saddle stapling mode except for the folding line process using the folding line mechanism 350 are performed.

In other words, in the recording material post-processing device 22, for the recording material S, the position determining process by using the position determining and housing tray 150 and the saddle stapling process by using the saddle stapling mechanism 620 of the expanded auxiliary device 600 are performed not through the folding line process by using the folding line mechanism 350 of the additional auxiliary device 300.

When the edge stapling mode is selected by the operation unit 400 of the image forming device 21, the recording material S for which the image creation has been completed by the image forming device 21 is led to the recording material post-processing device 22.

At this moment, since the shift claw 121 of the branched transport path 120 is shifted to a position (position A) for selecting the one branched transport path 120*a*, and the recording material S that has been transported to the recording material post-processing device 22 passes the one recording material transporting path 120*a* from the recording material transporting path 110 and is positioned and housed in the position determining and housing tray 150. Thereafter, for the recording material, the edge stapling process by using the edge stapling mechanism 170 is performed, and the recording material is transported and discharged to the recording material housing tray 105 by the discharge roll 117.

Particularly in this exemplary embodiment, although the expanded auxiliary device 600 is provided, the recording material S discharged from the discharge roll 117 passes through the recording material transporting path 602 of the expanded auxiliary casing 601 and then is transported and discharged to the recording material housing tray 105, not through the saddle stapling process by using the saddle stapling mechanism 620.

The expanded auxiliary device 600 may be disposed in post-processing device casing 100 to be vertically movable. In such a case, for example, when a post-processing mode that does not use the expanded auxiliary device 600 is selected, the expanded auxiliary device 600 is, for example, moved to the upper side, and the recording material S discharged from the discharge roll 117 may be directly transported and discharged to the recording material housing tray 105.

Figure 27A:
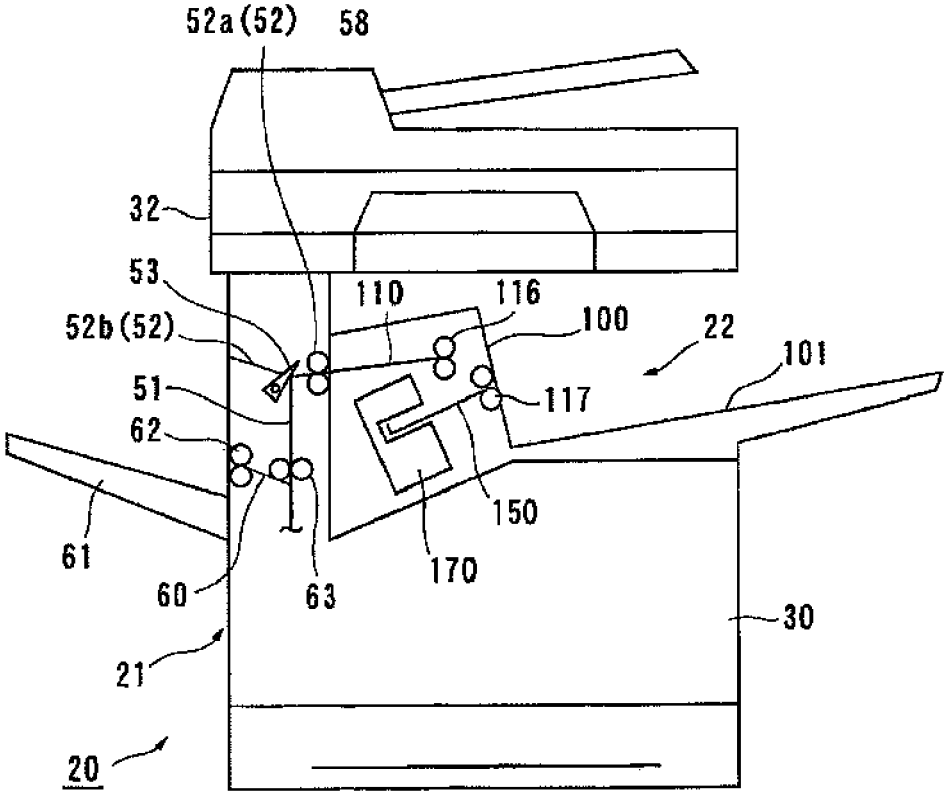
FIG. 27A is a diagram showing the whole configuration of a recording material processing apparatus according to Exemplary embodiment 5.

FIG. 27A shows an overview of a recording material processing apparatus according to exemplary embodiment 5.

In the figure, the recording material processing apparatus 20 of a standard equipment specification includes an image forming device 21 and a recording material post-processing device 22 (having the position determining and housing tray 150 and the edge stapling mechanism 170) that are almost the same as those of exemplary embodiment 1.

Figure 27B:
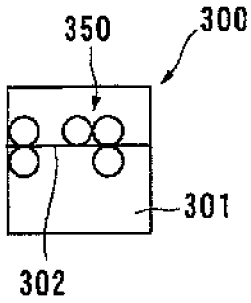
FIG. 27B is a diagram showing an example of an additional auxiliary device.
Figure 27C:
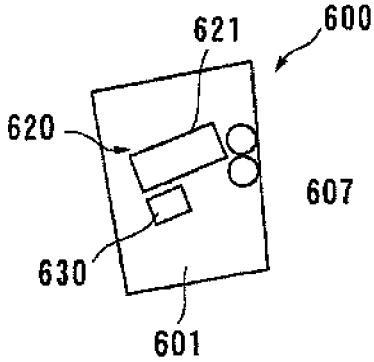
FIG. 27C is a diagram showing an example of an expanded auxiliary device.
Figure 28:
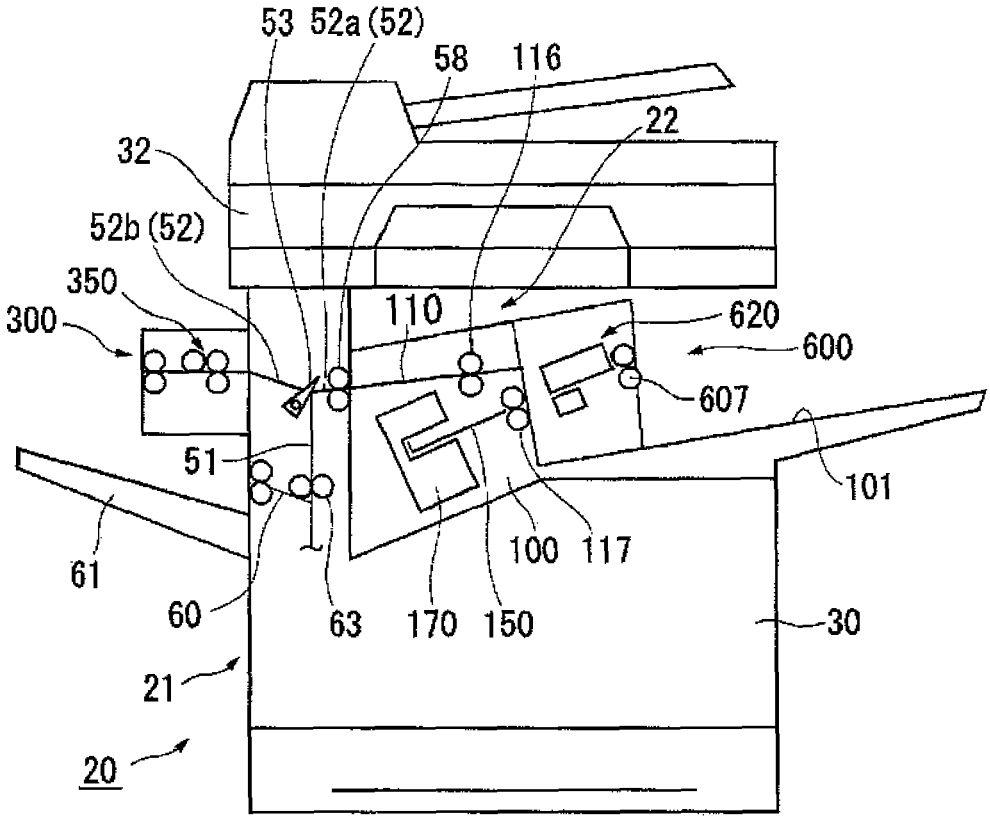
FIG. 28 is a diagram showing a form in which an addition auxiliary device and an expanded auxiliary device are added to a recording material processing apparatus according to exemplary embodiment 5.

In this exemplary embodiment, the recording material processing apparatus 20, as shown in FIGS. 27B, 27C, and 28, is configured by detachably attaching an additional auxiliary device 300 to a device casing 30 of the image forming device 21 and detachably attaching an expanded auxiliary device 600 to a post-processing device casing 100 of the recording material post-processing device 22.

Here, the additional auxiliary device 300 is disposed in a position corresponding to a branched transport path 52*b* of the device casing 30, a recording material transporting path 302 is disposed in an additional auxiliary device casing 301, similarly to exemplary embodiment 4, and a folding line mechanism 350 is disposed in the recording material transporting path 302.

On the other hand, the expanded auxiliary device 600 is disposed in a position corresponding to a discharge roll 117 of the post-processing device casing 100, a recording material transporting path 602 (see FIG. 21) is disposed in an expanded auxiliary casing 601, similarly to exemplary embodiment 4, and a saddle stapling mechanism 620 (a saddle stapling mechanism main body 621 and an opposing member 630) is disposed in the recording material transporting path 602.

According to this exemplary embodiment, the recording material processing apparatus 20 is operated as follows.

For example, in an ordinary mode, the recording material S for which an image has been created by the image forming device 21 is transported and discharged to a recording material housing tray 61 through a branched discharge path 60.

On the other hand, in a folding line adding and saddle stapling mode, for the recording material S for which an image has been created by the image forming unit 21, first, a folding line process by using a folding line mechanism 350 of the additional auxiliary device 300 is performed. Next, the position of the recording material is determined by the position determining and housing tray 150, and then the saddle stapling process by using the saddle stapling mechanism 620 of the expanded auxiliary device 600 is performed for the recording material. Then, the recording material is discharged and housed in a recording material discharging unit 101 of the post-processing device casing 100.

In a simple saddle stapling mode, operations in the folding line adding and saddle stapling mode except for the folding line process by using the folding line mechanism 350 of the additional auxiliary device 300 are performed.

On the other hand, in an edge stapling mode, a position determining process by using the position determining and housing tray 150 and an edge stapling process by using the edge stapling mechanism 170 are performed without performing the folding line process by using the folding line mechanism 350 of the additional auxiliary device 300 and the saddle stapling process by using the saddle stapling mechanism 620 of the expanded auxiliary device 600.

Figure 29:
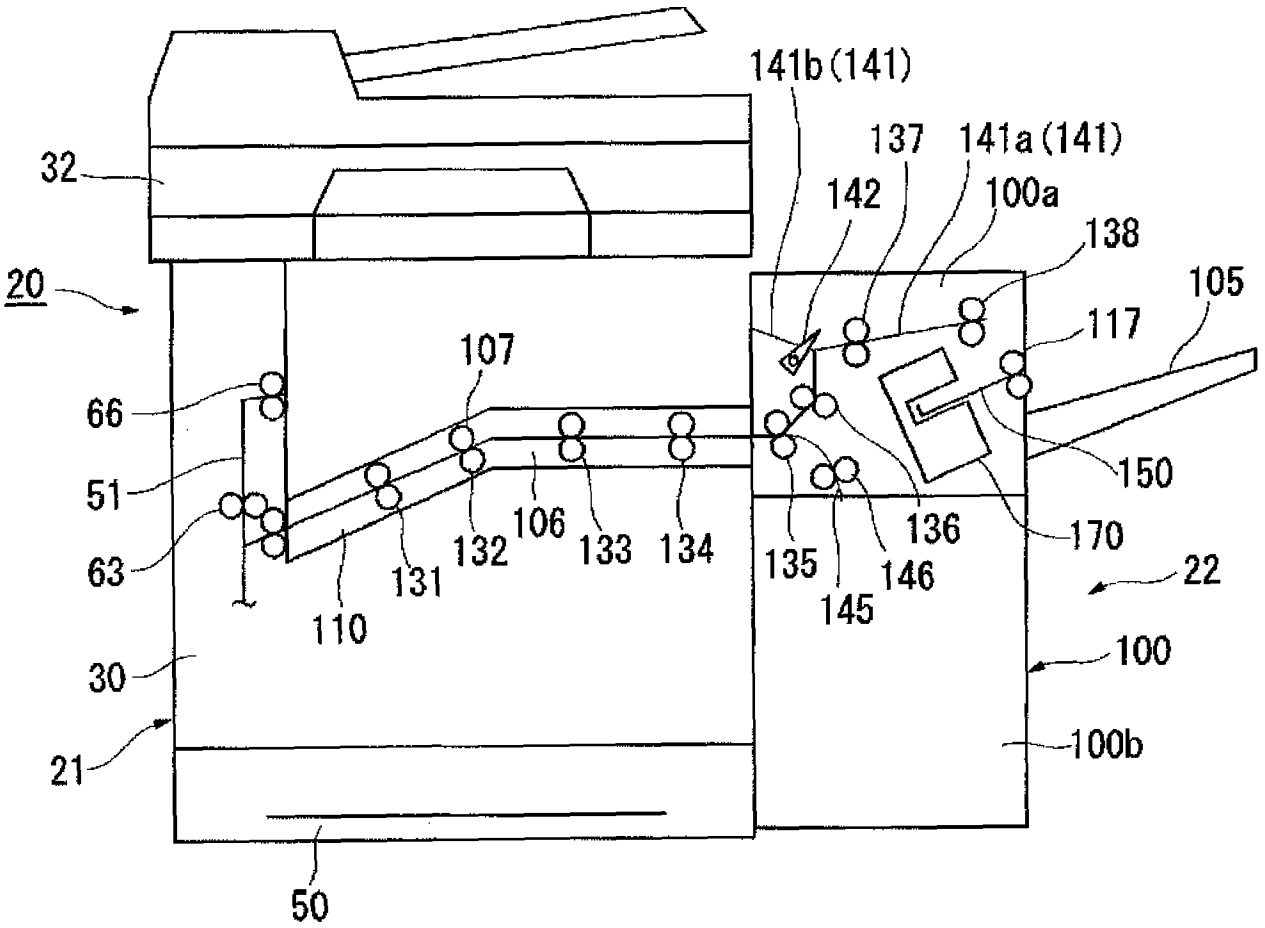
FIG. 29 is a diagram showing the whole configuration of a recording material processing apparatus according to exemplary embodiment 6.

FIG. 29 shows an overview of a recording material processing apparatus according to Exemplary embodiment 6.

In the figure, the recording material processing apparatus 20 of a standard equipment specification includes an image forming device 21 and a recording material post-processing device 22 (having a position determining and housing tray 150 and an edge stapling mechanism 170) that are almost the same as those of Exemplary embodiment 3.

However, in the recording material post-processing device 22, a post-processing device casing 100 is divided vertically, the position determining and housing tray 150 and the edge stapling mechanism 170 is housed in an upper post-processing device casing 100*a*, and a branched transport path 145 that is branched toward a lower post-processing device casing 100*b* is disposed in a recording material transporting path 140. In addition, a transport roll 146 is disposed in a part of the branched transport path 145, and a lower post-processing casing 100*b* is configured to serve as a rack for the upper post-processing casing 100*a*.

Figure 30:
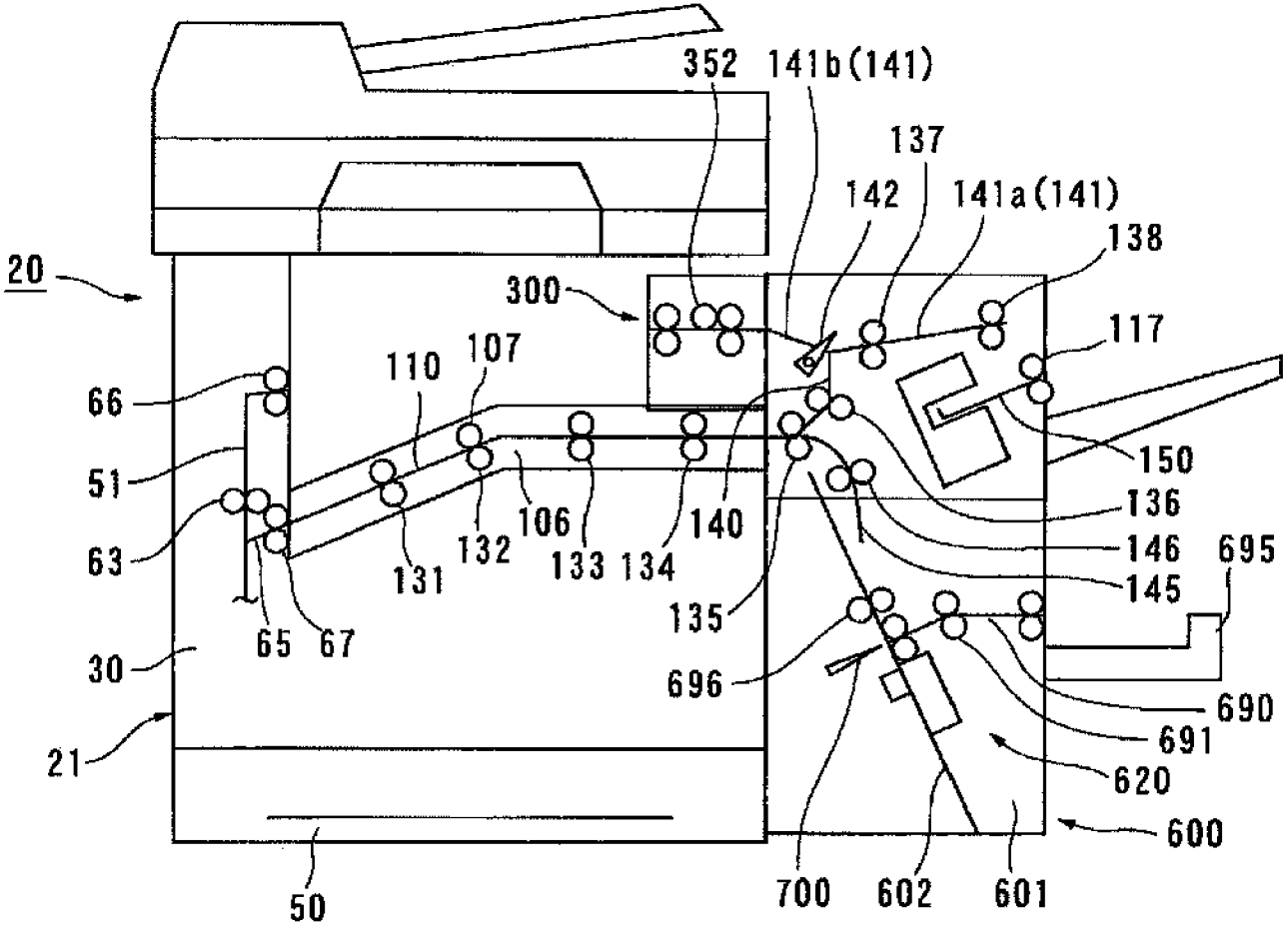
FIG. 30 is a diagram showing a form in which an addition auxiliary device and an expanded auxiliary device are added to a recording material processing apparatus according to exemplary embodiment 6.

In addition, in this exemplary embodiment, as shown in FIG. 30, an additional auxiliary device 300 is detachably attached to a portion near the upper post-processing device casing 100*a* of the recording material post-processing device 22 and a recording material transporting casing 106. In addition, the expanded auxiliary device 600, instead of the lower post-processing device casing 100*b* shown in FIG. 29, is detachably attached to the upper post-processing device casing 100*a*.

Here, the additional auxiliary device 300, similarly to those of exemplary embodiments 4 and 5, is configured by disposing a recording material transporting path 302 inside an additional auxiliary casing 301 and disposing a folding line mechanism 350 in the recording material transporting path 302.

In the expanded auxiliary device 600, as shown in FIGS. 30 and 31, a recording material transporting path 602 that extends downward with tilt is disposed inside an expanded auxiliary casing 601, a saddle stapling mechanism 620 (a saddle stapling mechanism main body 621 and an opposing member 630) is disposed in the recording material transporting path 602, and a center folding mechanism 700 that performs a center folding process for the recording material S in the center is disposed on the upstream side of the saddle stapling mechanism 620 in the recording material transporting path 602.

In addition, a branched transport path 690 that is branched from the recording material transporting path 602 is disposed in a position, in which the center folding mechanism 700 is disposed, of the recording material transporting path 602, and transport rolls 691 of an appropriate number are disposed in the branched transport path 690. In addition, on the outer side of the expanded auxiliary casing 601, a recording material housing tray 695 is disposed corresponding to the exit of the branched transport path 690. And the center-bound and center-folded recording material S is discharged and housed in the recording material housing tray 695.

In addition, on the upstream side of the center folding mechanism 700 in the recording material transporting path 602, a transport roll that can be rotated in the forward or reverse direction is disposed. Right after the transport roll 696, a position detector 697 for detecting the front end or the rear end of the recording material S is disposed.

Figure 31A:
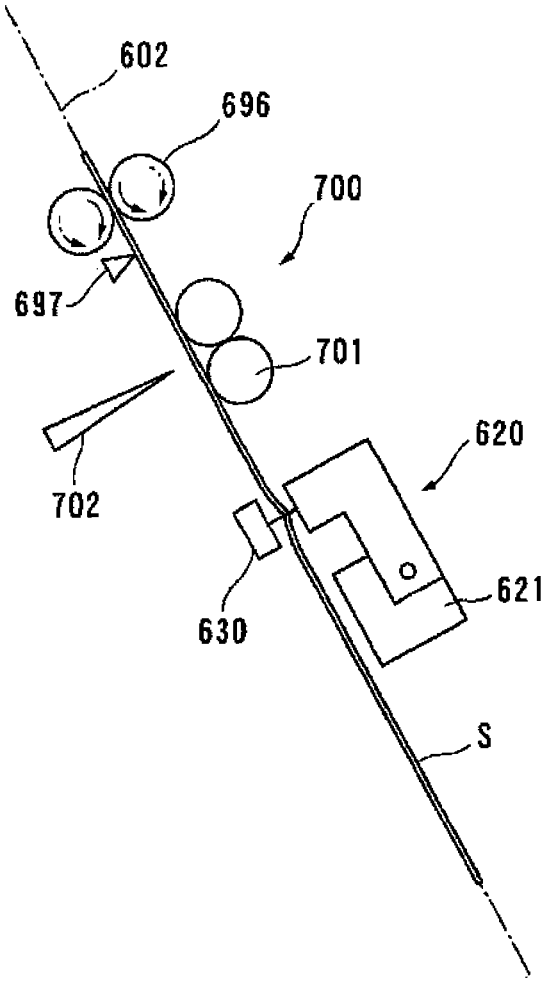
FIG. 31A is a diagram showing an expanded post-processing mechanism in detail used in exemplary embodiment 6 and FIG. 31B is a diagram showing an example operation of a center folding mechanism that is one element of the expanded post-processing mechanism.

In this exemplary embodiment, the center folding line mechanism 700, for example, as shown in FIG. 31A, includes a pair of center folding line rolls 701 and a folding blade 702. The pair of center folding line rolls 701 performs a center folding process for a center portion of the recording material S in the transport direction. And the folding blade 702 is disposed on a side opposite to a pinched area of the center folding rolls 701 with respect to the recording material transporting path 602 and can move forward or backward with respect to the pinched area of the pinched area side of the center folding rolls 701 at a given timing.

Figure 31B:
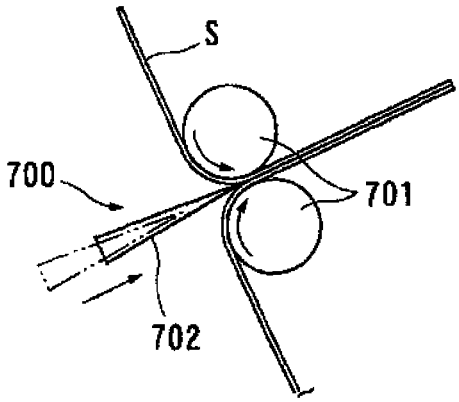

The center folding process of the center folding mechanism 700, as shown in FIG. 31B, is performed by (i) rotating the center folding roll 701 in a direction for drawing the recording material S thereto and (ii) moving the folding blade 702 toward the center folding roll 701 side, in a state that the center of the recording material S in the transport direction reaches the center folding position of the center folding mechanism 700.

In addition, the position detector 697 detects a pass timing of the recording material S so as to determine the center portion of the recording material S in the transport direction reaches the center folding position of the recording material S of the saddle stapling mechanism 620.

FIG. 25 shows a control system of a recording material processing apparatus used in this exemplary embodiment.

In the figure, an image forming device 21 has an operation unit 400 and a control unit 410 that controls each operation target (a motor detector or the like) 420 based on information from the operation unit 400.

The recording material post-processing device 22 has a control unit 430 that that exchanges information with the control unit 410 of the image forming device 21. The recording material post-processing device 22 controls a process of shifting the shift claw 121, post processes performed by the folding line mechanism 350, the edge stapling mechanism 170, the saddle stapling mechanism 620, and the center folding mechanism 700 which are used as post-processing mechanisms, a process for determining the position of the recording material S in the position determining and housing tray 150, and the like, in addition to controlling each operation target (a motor detector or the like) 440 by using the control unit 430.

In this exemplary embodiment, the control unit 410 of the image forming device 21 and the control unit 430 of the recording material post-processing device 22 determine whether a post-process is included and whether the post-process is an edge stapling mode or a folding line adding and saddle stapling mode. When the post-process is not included, the control units perform an ordinary mode. Otherwise, the control units perform one of the edge stapling mode or the folding line adding and saddle stapling mode based on the post-processing mode.

For example, in the ordinary mode, a recording material S for which an image is created by the image forming unit 21 is transported and discharged to the recording material discharging unit 107 by the discharge roll 66 through the recording material transporting path 51.

This mode is performed by selecting all the center line adding mode, the saddle stapling mode, and the center folding mode by using the operation unit 400 of the image forming device 21.

In such a case, the recording material S for which an image has been created by the image forming device 21 is received by the recording material post-processing device 22 through the recording material transporting casing 106.

At this moment, since the shift claw 142 is shifted to a position (position A) for selecting one branched transport path 141*a*, and the recording material S is led to the one branched transport path 141*a* from the recording material transporting path 140. Then, the shift claw 142 is shifted to a position (position B) for connecting both the branched transport paths 141*a* and 141*b* together, and the recording material is led to the additional auxiliary device 300 by an switching back operation using the transport rolls 137 and 138.

Then, a folding line process is performed for the recording material S by the folding line mechanism 350 in the additional auxiliary device 300. Thereafter, the recording material S to which a folding line has been attached is returned to the one branched transport path 141*a* through the original branched transport path 141*b* from the additional auxiliary device 300.

Then, the shift claw 142 is shifted to position A again, and the recording material S is transported toward the recording material transporting path 140 side by the switching back operation of the transport rolls 137 and 138. Thereafter, the recording material S is led to the expanded auxiliary device 600 through the branched transport path 145 that is connected to the lower side.

In the expanded auxiliary device 600, as shown in FIGS. 30 and 31, the recording material S is transported by a given amount along the recording material transporting path 602 by the transport roll 696. When the center of the recording material S in the transport direction reaches the saddle stapling position of the saddle stapling mechanism 620, the saddle stapling process is performed for the recording material by the saddle stapling mechanism 620. Then, the recording material S is returned by a given amount in the opposite direction in the recording material transporting path 602 by the transport roll 696. When the center of the recording material S in the transport direction reaches the center folding position of the center folding mechanism 700, the center folding process is performed for the recording material by the center folding mechanism 700. Then, the center-bound and center-folded recording material S passes through the branched transport path 690, is transported by the transport roll 691, and is discharged and housed in the recording material housing tray 695.

In the edge stapling mode, the recording material S received by the recording material post-processing device 22 is led to the one branched transport path 141*a* side without performing the folding line process by using the folding line mechanism 350 of the additional auxiliary device 300, the saddle stapling process by using the saddle stapling mechanism 620 of the expanded auxiliary device 600, and the center folding process by using the center folding mechanism 700. Thereafter, the position determining process by using the position determining and housing tray 150 and the edge stapling process by using the edge stapling mechanism 170 are performed for the recording material.

Figure 32:
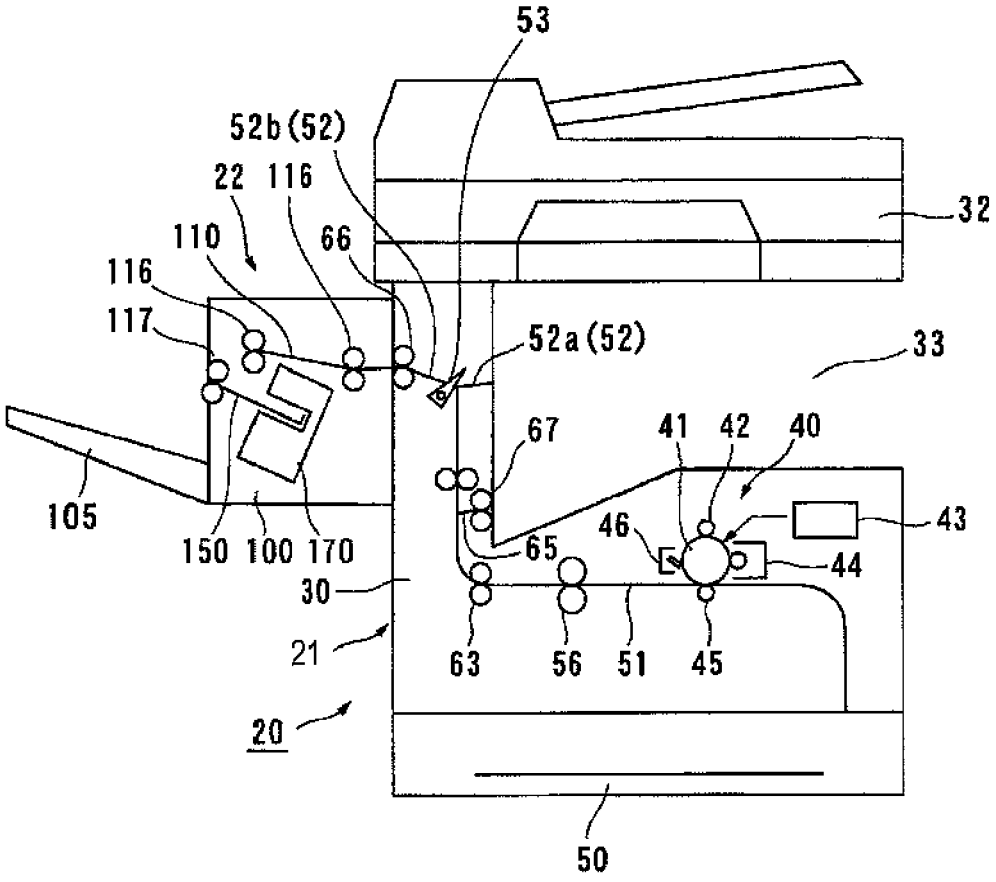
FIG. 32 is a diagram showing the whole configuration of a recording material processing apparatus according to exemplary embodiment 7.

FIG. 32 shows an overview of a recording material processing apparatus according to exemplary embodiment 7.

In the figure, the recording material processing apparatus 20 of a standard equipment specification includes an image forming device 21 and a recording material post-processing device 22 (having a position determining and housing tray 150 and an edge stapling mechanism 170) that are approximately the same as those of exemplary embodiment 5. To a same constituent element as that of exemplary embodiment 5, a same reference numeral as that of Exemplary embodiment 5 is assigned, and a detailed description thereof is omitted here.

However, the image forming device 21 has a layout of a recording material transporting path 51 which is different from that of exemplary embodiment 5. In addition, an image forming unit 40 uses an electro-photographic method, and an image is formed for a recording material S that is transported in an approximately horizontal direction different from that of exemplary embodiment 5.

The recording material post-processing device 22 of a standard equipment specification is detachably attached to the outer side of a device casing 30 of the image forming device 21.

The recording material post-processing device 22 has approximately the same constituent elements (however, plural transport rolls 116 is included) as those of exemplary embodiment 5. However, the layout of the constituent elements is bilaterally symmetrical to that of exemplary embodiment 1, and a recording material housing tray 105 is disposed on the side portion of a post-processing device casing 100.

Figure 33:
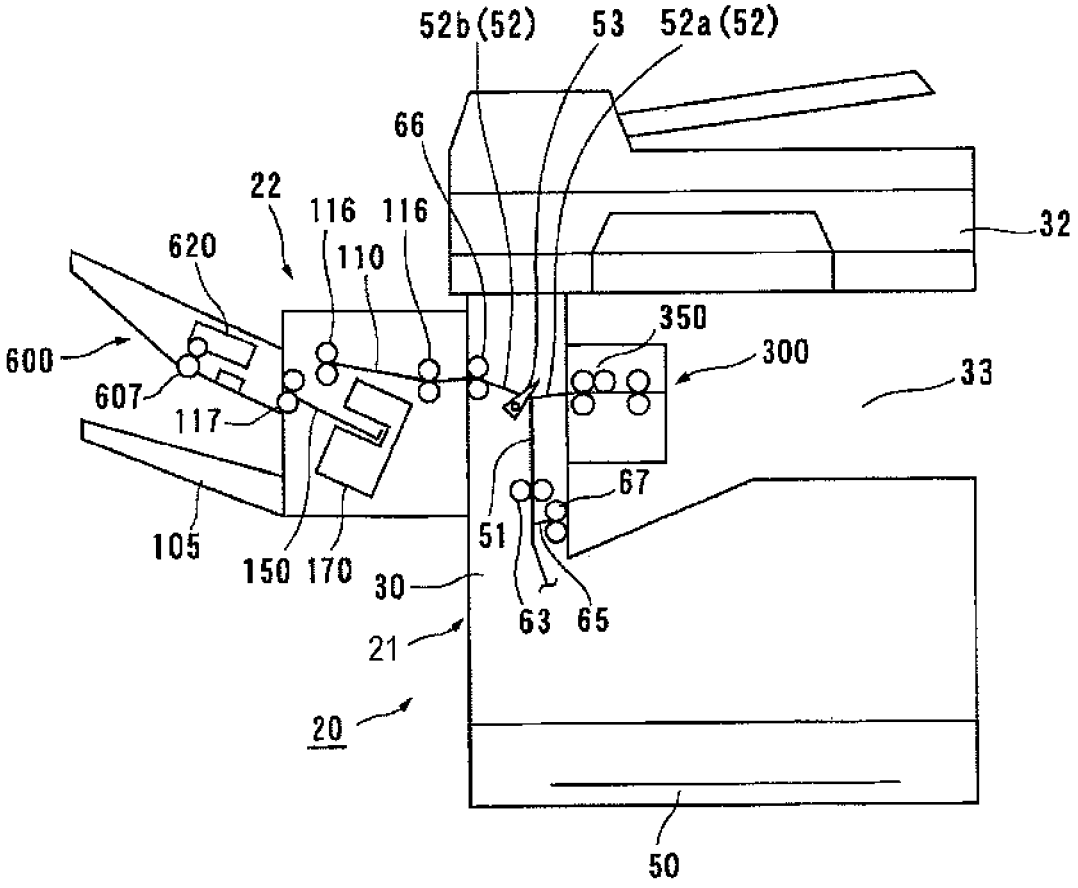
FIG. 33 is a diagram showing a form in which an additional auxiliary device is added to a recording material post-processing device according to exemplary embodiment 7.

In addition, in this exemplary embodiment, as show in FIG. 33, an additional auxiliary device 300 is detachably attached to a concave portion 33 side of a protruded part 31 of a device casing 30 of the image forming device 21. On the other hand, an expanded auxiliary device 600 is detachably attached to the recording material housing tray 105 side of a post-processing device casing 100 of the recoding sheet post-processing device 22.

In this exemplary embodiment, in the additional auxiliary device 300, similarly to that of exemplary embodiment 5, a recording material transporting path 302 is disposed inside an additional auxiliary casing 301, and a folding line mechanism 350 is disposed in the recording material transporting path 302. However, the layout of the constituent elements is bilaterally symmetrical to that of exemplary embodiment 5.

In the expanded auxiliary device 600, similarly to exemplary embodiment 5, a saddle stapling mechanism 620 is disposed inside an expanded auxiliary casing 601. However, the layout of the constituent elements is bilaterally symmetrical to that of exemplary embodiment 5.

The recording material processing apparatus 20 according to this exemplary embodiment which has the additional auxiliary device 300 and the expanded auxiliary device 600, approximately the same as exemplary embodiment 5, can perform an ordinary mode, a folding line adding and saddle stapling mode, a simple saddle stapling mode, and an edge stapling mode.

However, the layouts of the additional auxiliary device 300 and the expanded auxiliary device 600 are opposite to those of exemplary embodiment 5. Thus, for example, for performing the folding line adding and saddle stapling mode, the shift claw 53 is shifted to a position (position A) for selecting the initial one branched transport path 52*a*. However, the recording material S for which an image creation has been completed by the image forming device 21 is led to the additional auxiliary device 300 through the one branched transport path 52*a* from the recording material transporting path 51. Then, the folding line process is performed for the recording material S by the folding line mechanism 350 of the additional auxiliary device 300. Thereafter, the shift claw 53 is shifted to a position (position B) for connecting both the branched transport paths 52 (52*a* and 52*b*) together. Then, the recoding sheet S of the additional auxiliary device 300 is led to the recording material post-processing device 22 through the branched transport path 52. After the position of the recording material is determined by the position determining and housing tray 150 of the recording material post-processing device 22, the recording material is led to the expanded auxiliary device 600 by the discharge roll 117. Then, the saddle stapling process by using the saddle stapling mechanism 620 of the expanded auxiliary device 600 is performed for the recording material, and then the recording material is transported and discharged to the recording material housing tray 105.

In the simple saddle stapling mode, the operations of the folding line adding and saddle stapling mode except for the folding line process by using the folding line mechanism 350 of the additional auxiliary device 300 are performed. In the edge stapling mode, the position determining process by using the position determining and housing tray 150 and the edge stapling process by using the edge stapling mechanism 170 are performed without performing the post-process by using the additional auxiliary device 300 or the expanded auxiliary device 600.

Figure 34:
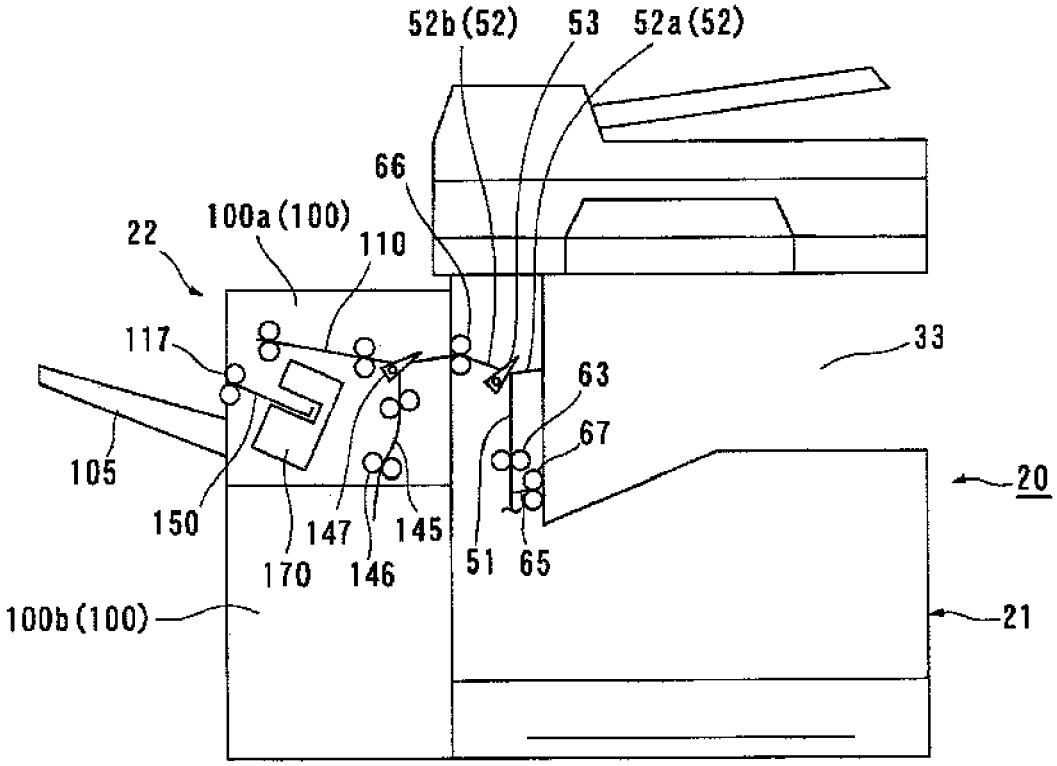
FIG. 34 is a diagram showing the whole configuration of a recording material processing apparatus according to Exemplary embodiment 8.

FIG. 34 shows an overview of a recording material processing apparatus according to exemplary embodiment 8.

In the figure, the recording material processing apparatus 20 of a standard equipment specification includes an image forming device 21 that is approximately the same as that of exemplary embodiment 5 and a recording material post-processing device 22 (having a position determining and housing tray 150 and an edge stapling mechanism 170) that is approximately the same as that of exemplary embodiment 6. To a same constituent element as that of exemplary embodiment 5 or 6, a same reference numeral as that of exemplary embodiment 5 or 6 is assigned, and a detailed description thereof is omitted here.

The recording material post-processing device 22 of a standard equipment specification is detachably attached to the outer side, which does not face the concave portion 33, of a device casing 30 of the image forming device 21.

In addition, the recording material post-processing device 22 has a post-processing device casing 100 (an upper post-processing device casing 100*a* and a lower post-processing device casing 100*b*) that can be divided vertically. In the upper post-processing device casing 100*a*, a recording material transporting path 110 that extends in an approximately horizontal direction is disposed. In the recording material transporting path 110, discharge rolls 116 of an appropriate number (in this example, two) are disposed. In addition, a branched transport path 145 that is branched from the recording material transporting path 110 is disposed toward a lower side. In addition, in a branching position of the recording material transporting path 110 and the branched transport path 145, a shift claw 147 is disposed. In addition, in the branched transport path 145, transport rolls 146 of an appropriate number (in this example, two) are disposed.

Below the recording material transporting path 110, a position determining and housing tray 150 and an edge stapling mechanism 170 are disposed. In addition, the lower post-processing casing 100*b* serves as a rack for the upper post-processing casing 100*a*. In this exemplary embodiment, the recoding sheet transporting casing 106 used in exemplary embodiment 6 is not used.

Figure 35:
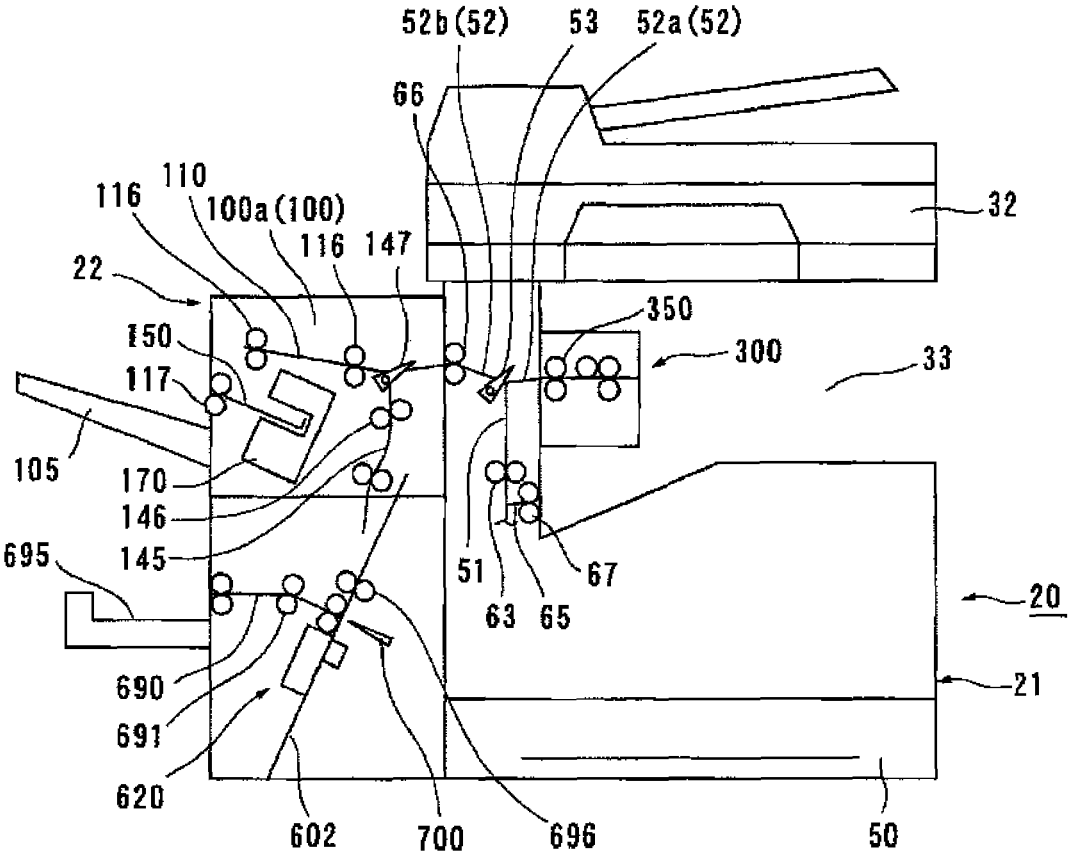
FIG. 35 is a diagram showing a form in which an addition auxiliary device and an expanded auxiliary device are added to a recording material post-processing device according to exemplary embodiment 8.

In addition, in this exemplary embodiment, as show in FIG. 35, an additional auxiliary device 300 is detachably attached to a concave portion 33 side of a protruded part 31 of a device casing 30 of the image forming device 21. In addition, an expanded auxiliary device 600, instead of the lower processing device casing 100*b* shown in FIG. 34, is detachably attached to the upper post-processing device casing 100*a*.

In this exemplary embodiment, in the additional auxiliary device 300, similarly to that of exemplary embodiment 6, a recording material transporting path 302 is disposed inside an additional auxiliary casing 301, and a folding line mechanism 350 is disposed in the recording material transporting path 302. However, the layout of the constituent elements is bilaterally symmetrical to that of exemplary embodiment 6.

In the expanded auxiliary device 600, similarly to exemplary embodiment 6, a saddle stapling mechanism 620 and a center folding mechanism 700 are disposed inside an expanded auxiliary casing 601. However, the layout of the constituent elements is bilaterally symmetrical to that of exemplary embodiment 6.

Thus, the recording material processing apparatus 20 according to this exemplary embodiment which has the additional auxiliary device 300 and the expanded auxiliary device 600, similarly to exemplary embodiment 6, can perform an ordinary mode, a folding line adding, saddle stapling, and center folding mode, and an edge stapling mode.

However, the layouts of the additional auxiliary device 300 and the expanded auxiliary device 600 are opposite to those of exemplary embodiment 6. Thus, for example, for performing the folding line adding and saddle stapling mode, the shift claw 53 is shifted to a position (position A) for selecting the initial one branched transport path 52*a*. However, the recording material S for which an image creation has been completed by the image forming device 21 is led to the additional auxiliary device 300 through the one branched transport path 52*a* from the recording material transporting path 51. Then, the folding line process is performed for the recording material by the folding line mechanism 350 of the additional auxiliary device 300. Thereafter, the shift claw 53 is shifted to a position (position B) for connecting both the branched transport paths 52 (52*a* and 52*b*) together. Then, the recoding sheet S of the additional auxiliary device 300 is led to the recording material post-processing device 22 through the branched transport path 52.

In the recording material post-processing device 22, the shift claw 147 is shifted to a position for selecting the branched transport path 145, and the recording material S to which a folding line is added is led to the expanded auxiliary device 600 through the branched transport path 145.

In the expanded auxiliary device 600, as shown in FIG. 35, the recording material S is transported by a given amount along the recording material transporting path 602 by the transport roll 696. When the center of the recording material S in the transport direction reaches the saddle stapling position of the saddle stapling mechanism 620, the saddle stapling process is performed for the recording material by the saddle stapling mechanism 620. Then, the recording material S is returned by a given amount in the opposite direction in the recording material transporting path 602 by the transport roll 696. When the center of the recording material S in the transport direction reaches the center folding position of the center folding mechanism 700, the center folding process is performed for the recording material by the center folding mechanism 700. Then, the center-bound and center-folded recording material S passes through the branched transport path 690, is transported by the transport roll 691, and is discharged and housed in the recording material housing tray 695.

In the ordinary mode, the recording material S for which an image creation has been completed by the image forming device passes the branched transport 65 and is transported and is transported and discharged by the discharge roll 67 using the bottom part of the concave portion 33 of the device casing 30 as a recording material discharging unit. In the edge stapling mode, the position determining process by using the position determining and housing tray 150 and the edge stapling process by using the edge stapling mechanism 170 are performed without performing the post-process using the additional auxiliary device 300 or the expanded auxiliary device 600.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material post-processing device that performs a post-process for a recording material, the recording material post-processing device comprising:

a post-processing device casing that has a branched transport path branched in two through which the recording material is transported;

a post-processing mechanism that performs a given post-process for the recording material transported to one branched transport path;

an additional post-processing mechanism that performs an additional post-process other than the post-process performed by the post-processing mechanism for the recording material transported to the other branched transport path; and a transport control unit that controls transport of the recording material such that the post-process using the post-processing mechanism is performed after the additional post-process using the additional post-processing mechanism, wherein the post-processing mechanism is a stapling mechanism and the additional post-processing mechanism is a folding mechanism, wherein the post-processing device casing to which the post-processing mechanism is installed is disposed on a recording material discharging unit having a concave portion disposed in an image forming device casing.

2. The recording material post-processing device according to claim 1, wherein the additional post-processing mechanism is installed to an additional auxiliary device which is detachably attached to at least one of an image forming device casing and the post-processing device casing.

3. The recording material post-processing device according to claim 1, wherein the additional post-processing mechanism is disposed on an outer side of at least one of the image forming device casing and the post-processing device casing, and wherein the transport control unit transports the recording material to the one branched transport path, and then performs the additional post-process by using the additional post-processing mechanism with a state that a part of the recording material is discharged outside at least one of an image forming device casing and the post-processing device casing maintained.

4. The recording material post-processing device according to claim 1, wherein an expanded auxiliary device to which an expanded post-processing mechanism is installed is additionally disposed to be detachably attached to the post-processing device casing.

5. The recording material post-processing device according to claim 1, wherein the transport control unit transports a subsequent recording material to be led to the branched transport path on the additional post-processing mechanism side after a rear end of the recording material for which the additional post-process is performed by the additional post-processing mechanism (i) passes through a branching position of the branched transport path and (ii) arrives at the branched transport path on the post-processing mechanism side.

6. A recording material processing apparatus comprising:

an image forming unit that forms an image on a recording material; and a branched transport path that is branched in two through which the recording material is transported to be discharged;

a recording material post-processing unit that performs a post-process for the recording material on which the image is formed by the image forming unit;

wherein the recording material post-processing unit comprises:

a post-processing mechanism that performs a post-process for the recording material transported from one branched transport path;

an additional post-processing mechanism that performs an additional post-process other than the post-process performed by the post-processing mechanism for the recording material which is transported from the other branched transport path; and a transport control unit that controls transport of the recording material such that the post-process using the post-processing mechanism is performed after the additional post-process using the additional post-processing mechanism is performed, wherein the branched transport path is contained in the recording material post-processing unit, wherein the post-processing mechanism is a stapling mechanism and the additional post-processing mechanism is a folding mechanism, wherein a post-processing device casing to which the post-processing mechanism is installed is disposed on a recording material discharging unit having a concave portion disposed in an image forming device casing.

7. A recording material processing apparatus comprising:

an image forming unit that forms an image on a recording material; and a branched transport path that is branched in two through which the recording material is transported to be discharged;

a recording material post-processing unit that performs a post-process for the recording material on which the image is formed by the image forming unit;

wherein the recording material post-processing unit comprises:

a post-processing mechanism that performs a post-process for the recording material transported from one branched transport path;

an additional post-processing mechanism that performs an additional post-process other than the post-process performed by the post-processing mechanism for the recording material which is transported from the other branched transport path; and a transport control unit that controls transport of the recording material such that the post-process using the post-processing mechanism is performed after the additional post-process using the additional post-processing mechanism is performed, wherein the transport control unit transports a subsequent recording material to be led to the branched transport path on the additional post-processing mechanism side after a rear end of the recording material for which the additional post-process is performed by the additional post-processing mechanism (i) passes through a branching position of the branched transport path and (ii) arrives at the branched transport path on the post-processing mechanism side, wherein the post-processing mechanism is a stapling mechanism and the additional post-processing mechanism is a folding mechanism, wherein a post-processing device casing to which the post-processing mechanism is installed is disposed on a recording material discharging unit having a concave portion disposed in an image forming device casing.

8. A recording material processing apparatus comprising:

an image forming device that forms an image on a recording material; and a recording material post-processing device that performs a post-process for the recording material on which the image is formed by the image forming device, wherein the recording material post-processing device includes:

a post-processing device casing that has a branched transport path branched in two through which the recording material is transported;

a post-processing mechanism that performs a post-process for the recording material transported to one branched transport path;

an additional post-processing mechanism that performs an additional post-process other than the post-process performed by the post-processing mechanism for the recording material transported to the other branched transport path; and a transport control unit that controls transport of the recording material such that the post-process using the post-processing mechanism is performed after the additional post-process using the additional post-processing mechanism, wherein the post-processing mechanism is a stapling mechanism and the additional post-processing mechanism is a folding mechanism, wherein the post-processing device casing to which the post-processing mechanism is installed is disposed on a recording material discharging unit having a concave portion disposed in an image forming device casing.

* * * * *